US012103132B2

(12) United States Patent
Kato et al.

(10) Patent No.: US 12,103,132 B2
(45) Date of Patent: Oct. 1, 2024

(54) CENTRIFUGAL BARREL POLISHING MACHINE AND CENTRIFUGAL BARREL POLISHING METHOD

(71) Applicant: TIPTON CORP., Nagoya (JP)

(72) Inventors: Yoshiyuki Kato, Nagoya (JP); Yoshinari Sawada, Nagoya (JP)

(73) Assignee: TIPTON CORP., Nagoya (JP)

( * ) Notice: Subject to any disclaimer, the term of this patent is extended or adjusted under 35 U.S.C. 154(b) by 930 days.

(21) Appl. No.: 17/056,207

(22) PCT Filed: Jun. 4, 2019

(86) PCT No.: PCT/JP2019/022070

§ 371 (c)(1),
(2) Date: Nov. 17, 2020

(87) PCT Pub. No.: WO2020/008774

PCT Pub. Date: Jan. 9, 2020

(65) Prior Publication Data

US 2021/0229233 A1 Jul. 29, 2021

(30) Foreign Application Priority Data

Jul. 6, 2018 (JP) ..... 2018-128876

(51) Int. Cl.
*B24B 31/12* (2006.01)
*B24B 31/02* (2006.01)

(52) U.S. Cl.
CPC ..... *B24B 31/12* (2013.01); *B24B 31/0218* (2013.01)

(58) Field of Classification Search
CPC ..... B24B 31/12; B24B 31/02; B24B 55/00; B24B 31/0212; B24B 31/0218; B24B 31/033; B24B 49/12
(Continued)

(56) References Cited

U.S. PATENT DOCUMENTS 4,505,072 A * 3/1985 Kobayashi ..... B24B 31/02 451/329
5,531,637 A 7/1996 Kimura
2013/0088098 A1* 4/2013 Mueller ..... D06F 37/42 307/326

FOREIGN PATENT DOCUMENTS

JP H08-229802 A 9/1996
JP 2009-190151 A 8/2009
(Continued)

OTHER PUBLICATIONS

Translation of JP-5638406-B2 (Year: 2023).*
(Continued)

*Primary Examiner* — Edward F Landrum
*Assistant Examiner* — Sarah Akyaa Fordjour
(74) *Attorney, Agent, or Firm* — Smith, Gambrell & Russell, LLP

(57) ABSTRACT

To detect whether barrel lids are fixed.

A centrifugal barrel polishing machine (A) includes: a plurality of rotary tanks (50) that rotate planetarily; barrel lids (26) that are attachable to and detachable from the rotary tanks (50); and a plurality of clamp shafts (32) that are provided individually in the plurality of rotary tanks (50) so as to be rotatable integrally with the rotary tanks (50). Each of the clamp shafts (32) is displaceable between in a fixing form for fixing the barrel lid (26) to the rotary tank (50) and in a releasing form for releasing the fixation of the barrel lid (26). It is detected by a first detection means (40) whether the rotary tank (50) is positioned in a detection area (D) on a revolution path of the rotary tank (50), and it is detected
(Continued)

by a second detection means (43) whether the clamp shaft (32) of the rotary tank (50) positioned in the detection area (D) is displaced to the fixing form.

7 Claims, 15 Drawing Sheets

(58) Field of Classification Search
USPC ..... 451/32, 326–329, 113, 8
See application file for complete search history.

(56) References Cited

FOREIGN PATENT DOCUMENTS

| | | | | |
|---|---|---|---|---|
| JP | 5042060 | B2 | 10/2012 | |
| JP | 5638406 | B2 * | 12/2014 | |
| JP | 5986023 | B2 | 9/2016 | |
| KR | 10-2013-0061025 | A | 6/2013 | |
| WO | WO-2012039072 | A1 * | 3/2012 | ..... B24B 31/0218 |

OTHER PUBLICATIONS

Translation of WO-2012039072-A1 (Year: 2023).*
Office Action issued Feb. 16, 2022 for Korean Patent Office Patent Application No. 10-2020-7029172 (6 pages in Korean with English Translation).
International Search Report for PCT/JP2019/022070, mailed Sep. 3, 2019 (3 pgs. with English translation).
Written Opinion of the International Searching Authority for PCT/JP2019/022070, mailed Sep. 3, 2019 (3 pgs.).
European Search Report dated Sep. 17, 2021 for European Patent Application No. 19830289.5 (8 Pages).
Written Opinion of the International Searching Authority mailed Sep. 3, 2019 for International Patent Application No. PCT/JP2019/022070 (4 pages).
International Preliminary Report on Patentability mailed Jan. 12, 2021 for International Patent Application No. PCT/JP2019/022070 (4 pages in Japanese with English Translation).
Japanese Office Action mailed Sep. 27, 2019 for Japanese Patent Application No. 2018-128876 (2 pages in Japanese with English Translation).

* cited by examiner

CENTRIFUGAL BARREL POLISHING MACHINE AND CENTRIFUGAL BARREL POLISHING METHOD

TECHNICAL FIELD

The present invention relates to a centrifugal barrel polishing machine and a centrifugal barrel polishing method.

BACKGROUND ART

Patent Literature 1 discloses a centrifugal barrel polishing machine in which a plurality of barrel cases are provided at eccentric positions of a rotatable turret so as to be rotatable relatively to the turret, a barrel tank is housed in and fixed to each of the barrel cases, and a barrel lid is attached and fixed to an opening of the barrel tank. The centrifugal barrel polishing machine performs polishing in each of the barrel tanks by planetary rotation of the barrel cases, the barrel tanks and the barrel lids. During the polishing of the centrifugal barrel polishing machine, large centrifugal force of about 10 G and vibration act on the barrel tank and barrel lid. Therefore, a means for preventing the barrel lid from coming off from the barrel tank due to the centrifugal force or vibration is required. As the means for fixing the barrel lid to the barrel tank, there is considered a means in which a bolt attached to the barrel tank is passed through the barrel lid and a nut is screwed and tighten to the penetrating part of the bolt, as described in Patent Literature 1. In addition, there is also considered a means in which a clamp shaft having an eccentric cam is pivotally supported on the barrel case and the eccentric cam is pressed against the barrel tank.

CITATIONS LIST

Patent Literature

Patent Literature 1: JP H8-229802 A

SUMMARY OF INVENTION

Technical Problems

All fixation methods using bolts and clamp shafts are performed manually. Therefore, in the case where the fixing operation is not completed reliably, there is a concern that the barrel lid may rattle against the barrel tank and may be detached from the barrel tank due to the centrifugal force or vibration during polishing.

A first invention has been completed in view of the above circumstances, and an object thereof is to detect whether barrel lids are fixed.

An object of a second invention is to prevent barrel polishing from being executed in a state where barrel lids are not fixed.

Solutions to Problems

A centrifugal barrel polishing machine according to the first invention includes:

- a rotatable turret;
- a plurality of rotary tanks that are provided at eccentric positions of the turret and planetarily rotate with a rotation of the turret;
- barrel lids that are attachable to and detachable from the rotary tanks; and

- a plurality of fixation means that are provided individually in the plurality of rotary tanks so as to planetarily rotate integrally with the rotary tanks.

Each of the plurality of fixation means is displaceable between in a fixing form for fixing the barrel lid attached to the rotary tank and in a releasing form for releasing the fixation of the barrel lid to the rotary tank.

It is detected by a first detection means whether the rotary tank is positioned in a detection area set on a revolution path of the rotary tank.

It is detected by a second detection means whether the fixation means of the rotary tank positioned in the detection area is displaced to the fixing form.

A centrifugal barrel polishing method according to the second invention includes:

- providing a rotatable turret, a plurality of rotary tanks that are provided at eccentric positions of the turret and planetarily rotate with a rotation of the turret, barrel lids that are attachable to and detachable from the rotary tanks, and a plurality of fixation means chat are provided individually in the plurality of rotary tanks so as to planetarily rotate integrally with the rotary tanks, wherein each of the plurality of fixation means is displaceable between in a fixing form for fixing the barrel lid attached to the rotary tank and in a releasing form for releasing the fixation of the barrel lid to the rotary tank;
- detecting, by a first detection means, whether the rotary tank is positioned in a detection area set on a revolution path of the rotary tank;
- detecting, by a second detection means, whether the fixation means of the rotary tank positioned in the detection area is displaced to the fixing form; and then
- stopping the rotation of the turret on a condition that the second detection means has detected that the fixation means provided in at least one of the plurality of rotary tanks is not displaced to the fixing form, in a process of rotating the turret by one revolution before barrel polishing to confirm a fixation state of the barrel lid.

Advantageous Effects of Invention

According to the first invention, whether the barrel lid is fixed to the rotary tank can be determined based on the detection result of the second detection means when the rotary tank is positioned in the detection area. Since the first detection means for detecting whether the rotary tank is positioned in the detection area is provided, all the rotary tanks can be detection targets of the second detection means. As a result, it is possible to avoid the detection by the second detection means being overlooked. Therefore, the detection as to whether the barrel lid is fixed to the rotary tank can reliably be executed for all the barrel lids.

Further, according to the second invention, when it is detected that at least one of the plurality of barrel lids is not fixed, the rotation of the turret is stopped. Thus, it is possible to prevent barrel polishing from being executed in a state where the barrel lid is not fixed. Improper fixation of the barrel lid is detected before execution of barrel polishing, so that it is possible to prevent damages to the centrifugal barrel polishing machine and generation of defective polishing products.

DESCRIPTION OF EMBODIMENTS

Figure 1:
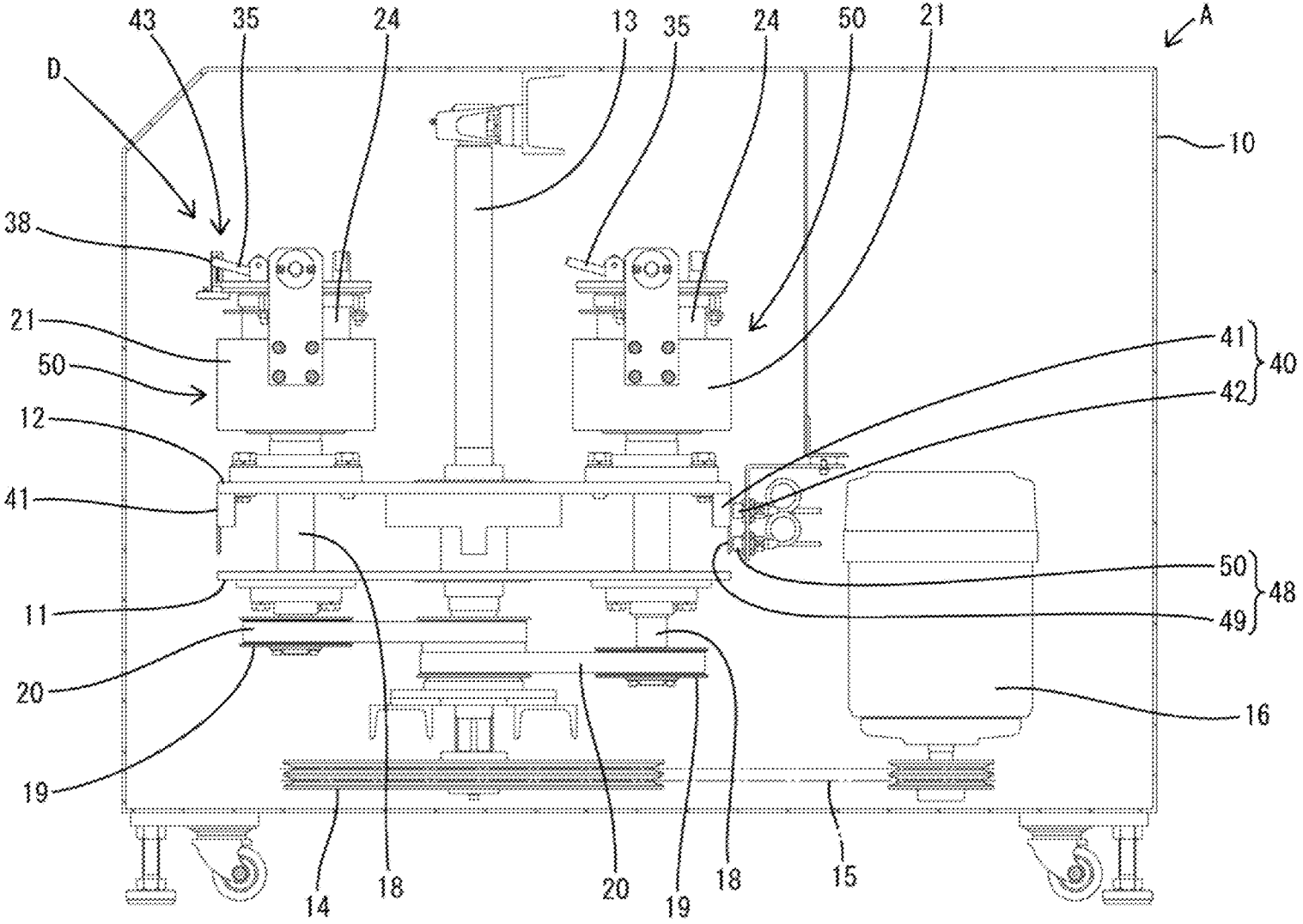
FIG. 1 is a side sectional view of a centrifugal barrel polishing machine of Example 1.

In the first and second inventions, each of the rotary tanks may include: a barrel case which rotates integrally with a rotation shaft provided on the turret so as to be planetarily rotatable; and a barrel main body which is attachable to and detachable from the barrel case and to which the barrel lid is attached to form a barrel tank.

In the first and second inventions, each of the rotary tanks may be rotatable integrally with the rotation shaft provided on the turret so as to be planetarily rotatable, and the barrel lid may be attached to the rotary tank to form the barrel tank.

In the first and second inventions, the detection area may be set continuously in an arc shape along a revolution direction of the rotary tank. According to this configuration, a detection target range of the second detection means is broad. Therefore, detection by the second detection means can be performed while the rotary tank is being revolved, even if there is a variation in the position of the rotary tank on the turret or in the position of the fixation means in the rotary tank.

In the first and second inventions, the second detection means may have a light emitting unit that irradiates the fixation means with detection light in parallel to a tangential direction of the revolution path of the rotary tank. According to this configuration, the displacement amount of the fixation means which revolves integrally with the rotary tank, i.e., the positional deviation of the fixation means with respect to the detection light, is small on a projection plane orthogonal to the irradiation direction of the detection light. Therefore, the detection by the second detection means can be performed with high accuracy.

In the first and second inventions, a displacement direction of the fixation means between in the fixing form and in the releasing form may be a direction intersecting an irradiation direction of the detection light. According to this configuration, the displacement amount of the fixation means between in the fixing form and in the releasing form is large on the projection plane orthogonal to the irradiation direction of the detection light. Therefore, the detection by the second detection means can be performed with high accuracy.

In the first and second inventions, the light emitting unit may have a linear light source along the displacement direction of the fixation means. According to this configuration, the detection by the second detection means can be performed with high accuracy, even if there is a variation in the displacement position of the fixation means in the fixing form.

In the first and second inventions, the detection light may be a laser light. According to this configuration, since the laser light which has high directivity is used, it is possible to prevent erroneous detection due to irradiation with the detection light to a member other than the fixation means.

In the first and second inventions, the fixation means is configured to be displaced at an eccentric position with respect to a rotation shaft of the rotary tank, and a rotation cycle of the rotary tank may be an integral multiple of a revolution cycle of the rotary tank. According to this configuration, when the rotary tank is positioned in the detection area, the fixation means always faces a specific direction regardless of the number of rotations of the turret. Therefore, it is not necessary to adjust the orientation of the rotary tank or the fixation means when detection by the second detection means is performed.

Example 1

Figure 5:
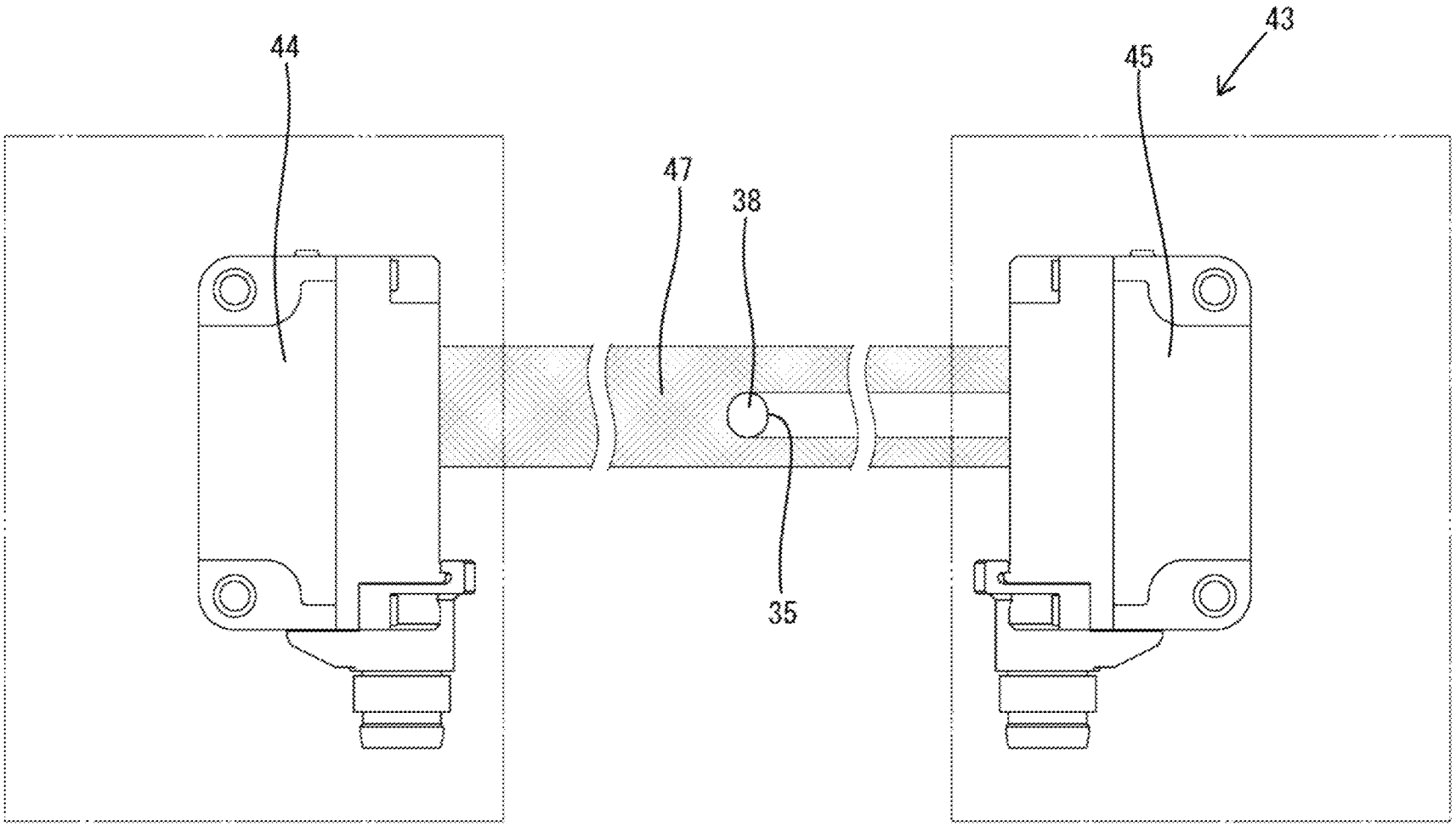
FIG. 5 is a front view of a second detection means.
Figure 6:
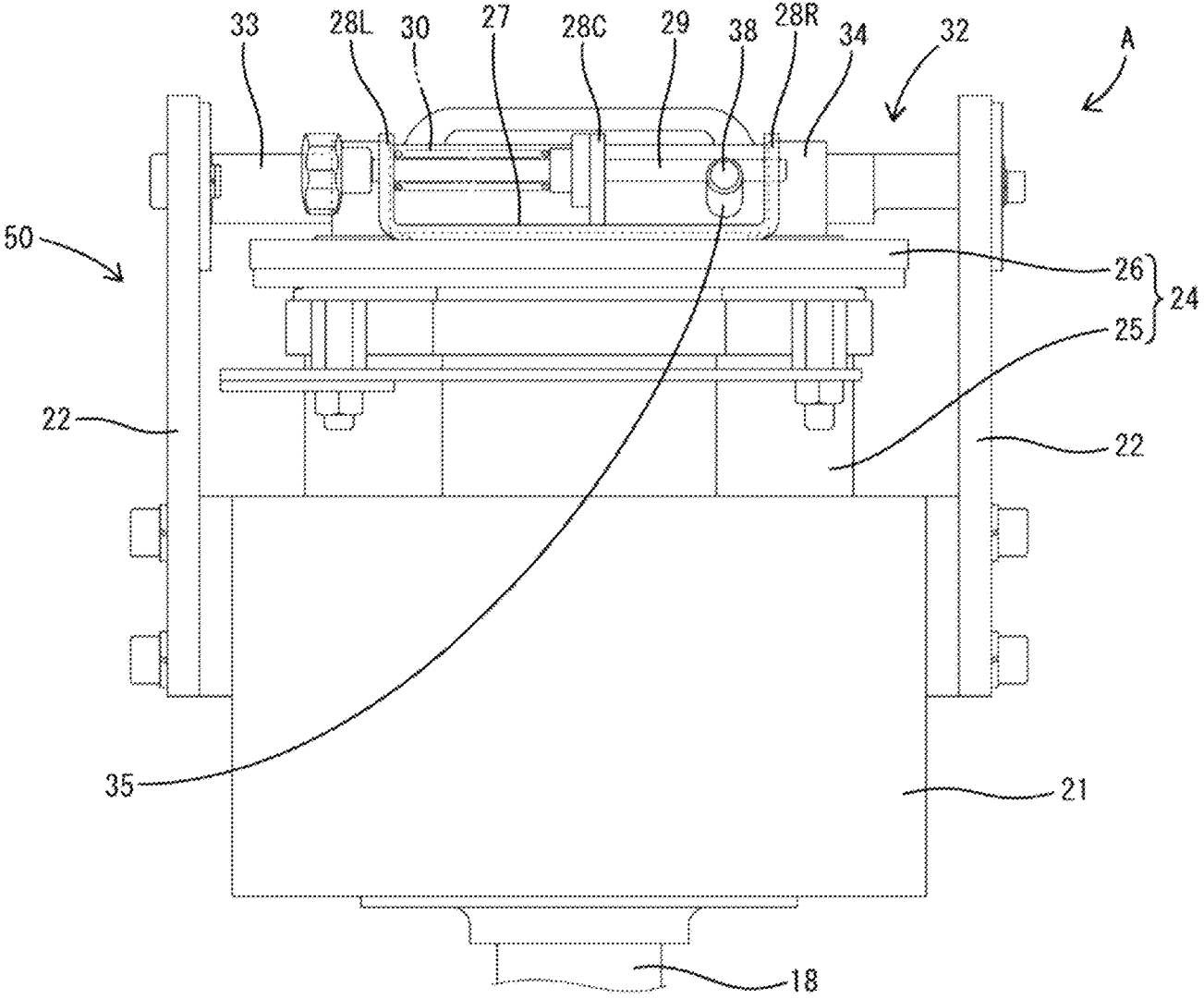
FIG. 6 is an enlarged front view showing the state where the barrel lid is properly fixed to the rotary tank.

Hereinafter, Example 1 that embodies the present invention will be described with reference to FIGS. 1 to 10. In the following description, with regard to the longitudinal direction, the left side in FIGS. 1 to 4, 7, and 8 is defined as a front side. With respect to the vertical direction, the orientations appearing in FIGS. 1, and 3 to 6 are defined as upper and lower sides as they are. With respect to the lateral direction, the orientations appearing in FIGS. 5 and 6 are defined as left and right sides as they are.

Figure 2:
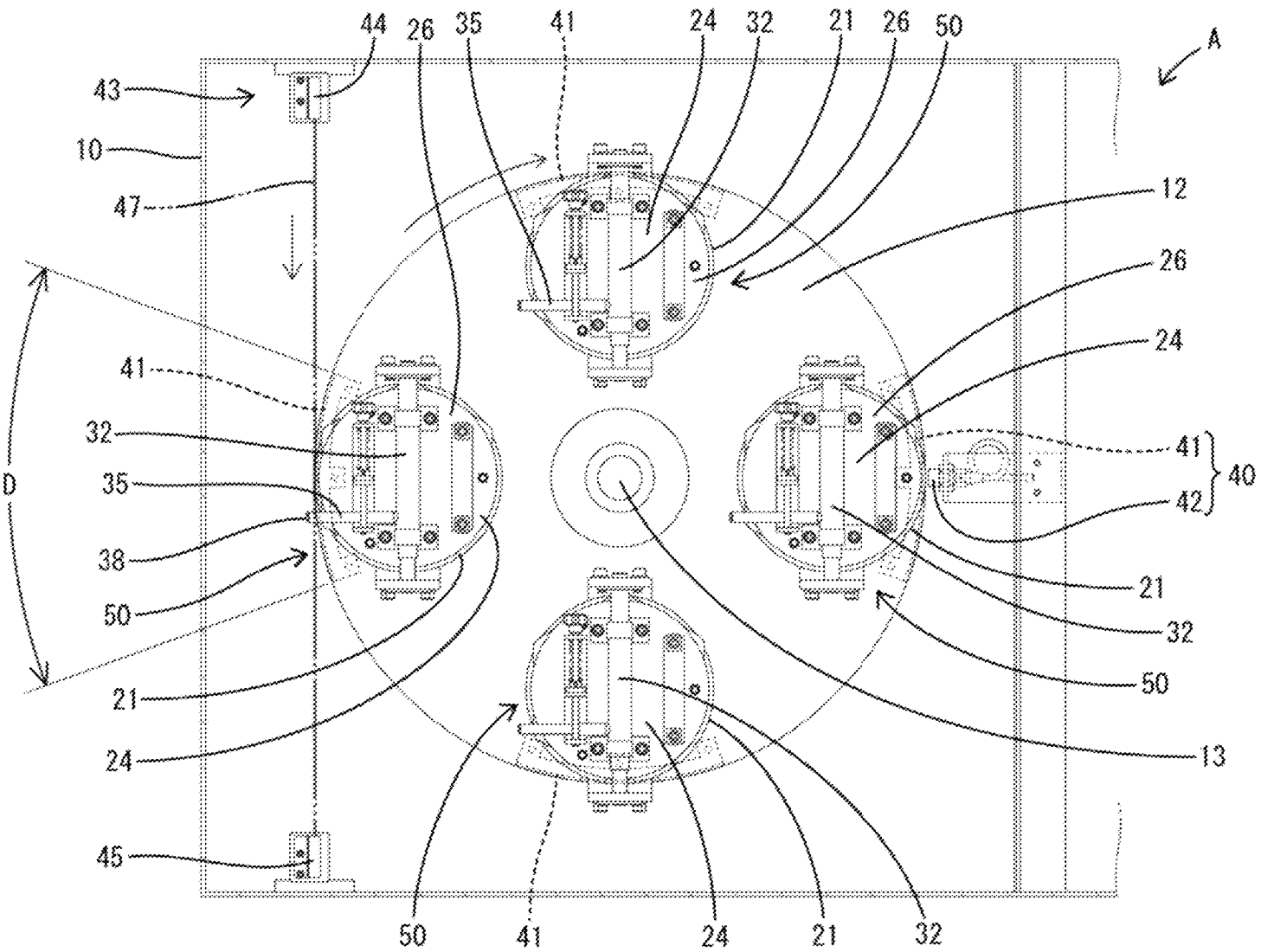
FIG. 2 is a plan view.

As shown in FIGS. 1 and 2, a centrifugal barrel polishing machine A according to Example 1 includes a base plate 11, a turret 12, four (a plurality of) rotary tanks 50, four (a plurality of) barrel lids 26, clamp shafts 32 (a fixation means set forth in the claims), a first detection means 40, and a second detection means 43. The base plate 11 is horizontally accommodated in a housing 10. The turret 12 has a horizontal circular plate shape and is housed in the housing 10. The four (plurality of) rotary tanks 50 are attached to the turret 12. The four (plurality of) barrel lids 26 are individually attached to the four rotary tanks 50. Each of the clamp shafts 32 is a member for fixing the barrel lid 26 to the rotary tank 50. The first detection means 40 and the second detection means 43 are provided inside the housing 10.

Each of the rotary tanks 50 includes a barrel case 21 and a barrel main body 25. The barrel case 21 is configured to rotate integrally with a rotation shaft 18 provided on the turret 12 so as to be planetarily rotatable. The barrel main bodies 25 are individually attachable to and detachable from the barrel cases 21. The barrel lid 26 is attached to the barrel main body 25 to thereby form a barrel tank 24. The barrel tank 24 can be attached to and detached from the barrel case 21 with the barrel lid 26 attached to the barrel main body 25.

The centrifugal barrel polishing machine A has a function of detecting whether the barrel lid 26 is properly fixed to the rotary tank 50 (that is, whether the barrel tank 24 is properly fixed to the barrel case 21) prior to a barrel polishing step. When it is detected that all the barrel lids 26 are properly fixed to the rotary tanks 50, the process shifts from the detection step to barrel polishing. When it is detected that at least any one of the four barrel lids 26 is not properly fixed to the rotary tank 50, the rotation of the turret 12 is stopped without shifting to barrel polishing. In the barrel polishing process, the four (plurality of) barrel tanks 24 are planetarily rotated about a vertical rotary shaft 13 and rotation shafts 18 to polish workpieces (not shown) charged in the barrel tanks 24.

Next, the structure of the centrifugal barrel polishing machine A will be described. On the base plate 11, the rotary shaft 13 whose axis is oriented in the vertical direction is rotatably supported. As shown in FIG. 1, the rotary shaft 13 is connected to a motor 16 via a revolution pulley 14 and a revolution belt 15. Control of drive and stop of the motor 16 and control of the rotation speed of the motor 16 are performed by a controller 17 (see FIG. 9). The controls by the controller 17 are performed based on detection signals from the first detection means 40 and the second detection means 43 and the operation of a timer 51.

The turret 12 is attached concentrically to the rotary shaft 13 so as to be rotatable integrally therewith. Four eccentric positions in the radial direction from the rotary shaft 13 are set on the turret 12 at an equal angular pitch of 90° on the same circumference which is concentric with the rotary shaft 13. At each of the eccentric positions, the rotation shaft 18 parallel to the rotary shaft 13 is attached so as to be rotatable relatively to the turret 12.

The rotation shaft 18 is connected to the rotary shaft 13 via a rotation pulley 19 and a rotation belt 20. Accordingly, when the turret 12 rotates integrally with the rotary shaft 13, the rotation force of the rotary shaft 13 is transmitted to the four rotation shafts 18, and the four rotation shafts 18 rotate relatively co the turret 12. The rotation cycle of the rotation shafts 18 is the same as the revolution cycle of the rotation shafts 18 (that is, rotation cycles of the turret 12 and the rotary shaft 13). The rotation direction of the rotation shafts 18 in a plan view is opposite to the revolution direction of the rotation shafts 18 (the rotation directions of the turret 12 and the rotary shaft 13).

As shown in FIGS. 3, 4, 6 and 7, the barrel case 21 has a bottomed cylindrical shape with its axis oriented in the vertical direction and its upper portion opened. The barrel case 21 is firmly attached in a state of being coaxially placed on an upper end of the rotation shaft 18, so as to rotate integrally with the rotation shaft 18. A pair of bearing members 22 rising upward are firmly attached to the barrel case 21. A bearing hole 23 penetrating in the lateral direction (the horizontal direction) is formed at an upper end portion of each of the bearing members 22.

Figure 3:
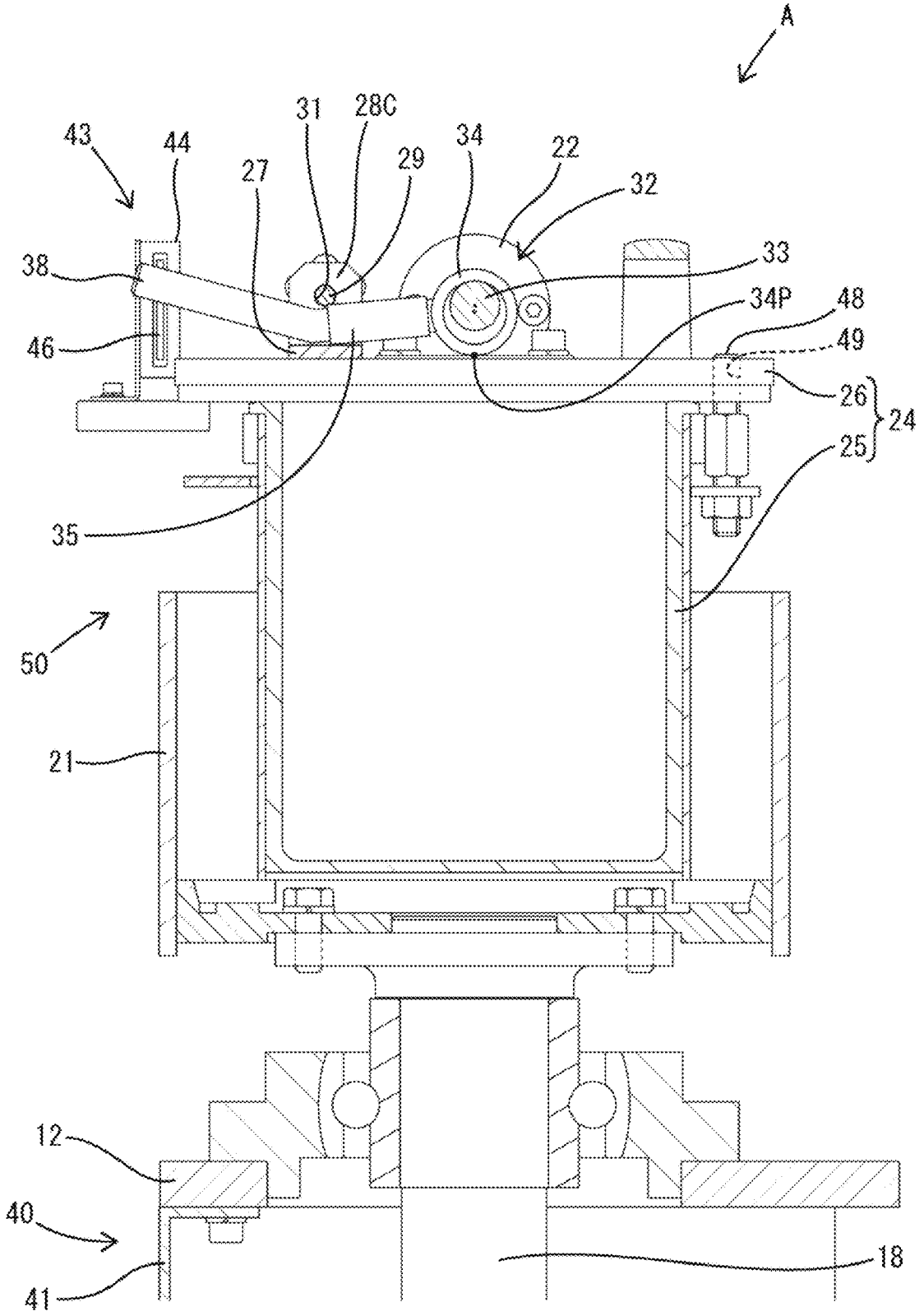
FIG. 3 is an enlarged side sectional view showing a state where a barrel lid is properly fixed to a rotary tank.
Figure 4:
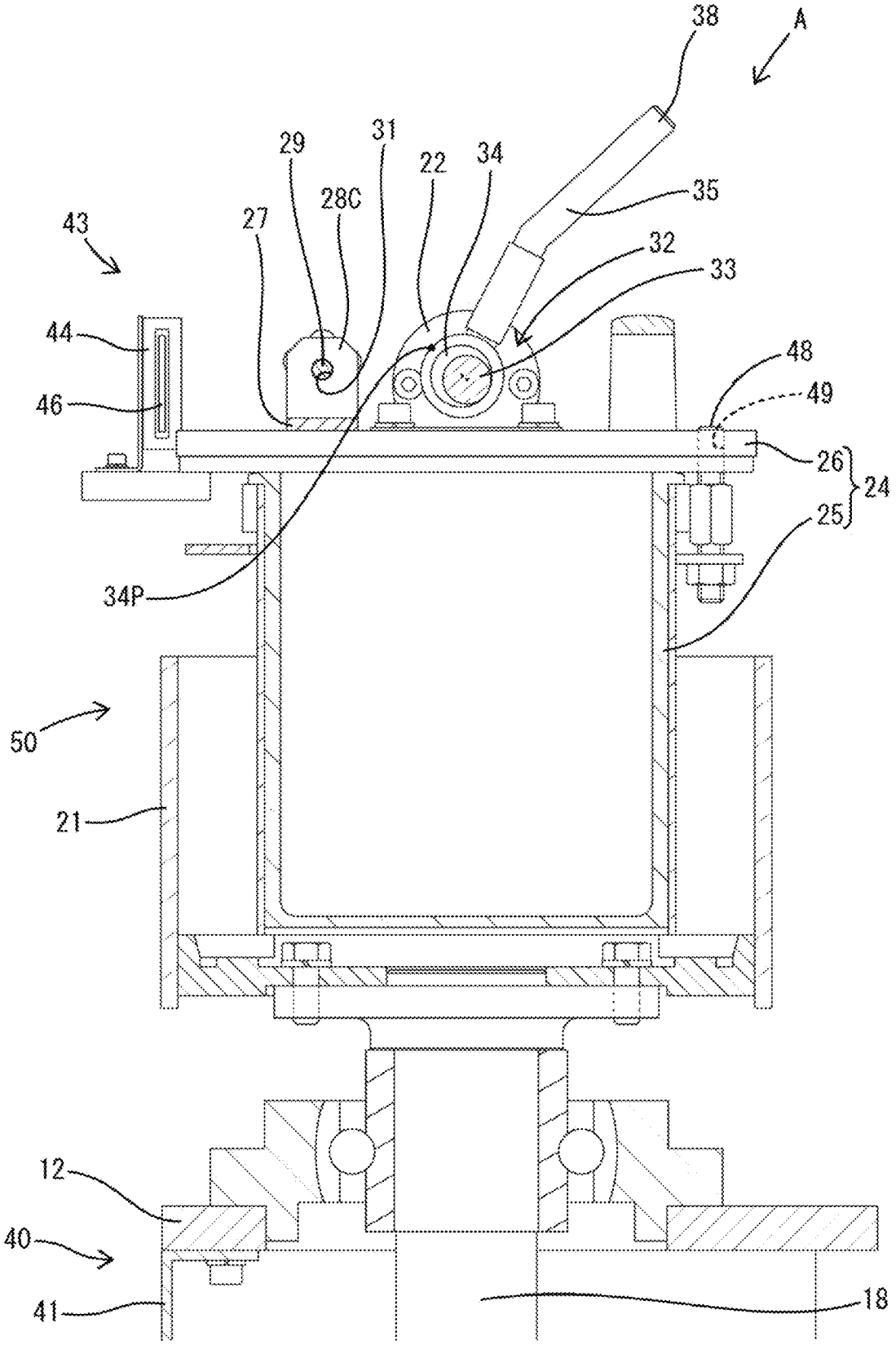
FIG. 4 is an enlarged side sectional view showing a state where the barrel lid is not properly fixed to the rotary tank.

As shown in FIGS. 3 and 4, the barrel tank 24 includes the barrel main body 25 and the barrel lid 26. The barrel main body 25 is a bottomed cylindrical-shaped member with its axis oriented in the vertical direction and its upper portion opened. The barrel lid 26 opens and closes an opening of the upper portion of the barrel main body 25. A plurality of positioning pins 48 protruding upward is provided on an outer periphery of an upper end portion of the barrel main body 25. A plurality of positioning holes 49 penetrating in the vertical direction are formed at an outer peripheral edge portion of the barrel lid 26. When masses (workpieces and polishing stones) are charged into the barrel main body 25, the barrel lid 26 is then attached to the barrel main body 25. At the time of the attachment, the barrel lid 26 is placed on an upper portion of the barrel main body 25, and the positioning holes 49 are fitted to the positioning pins 48. Thus, the barrel lid 26 is temporarily held in a state of being horizontally positioned with respect to the barrel main body 25.

Figure 7:
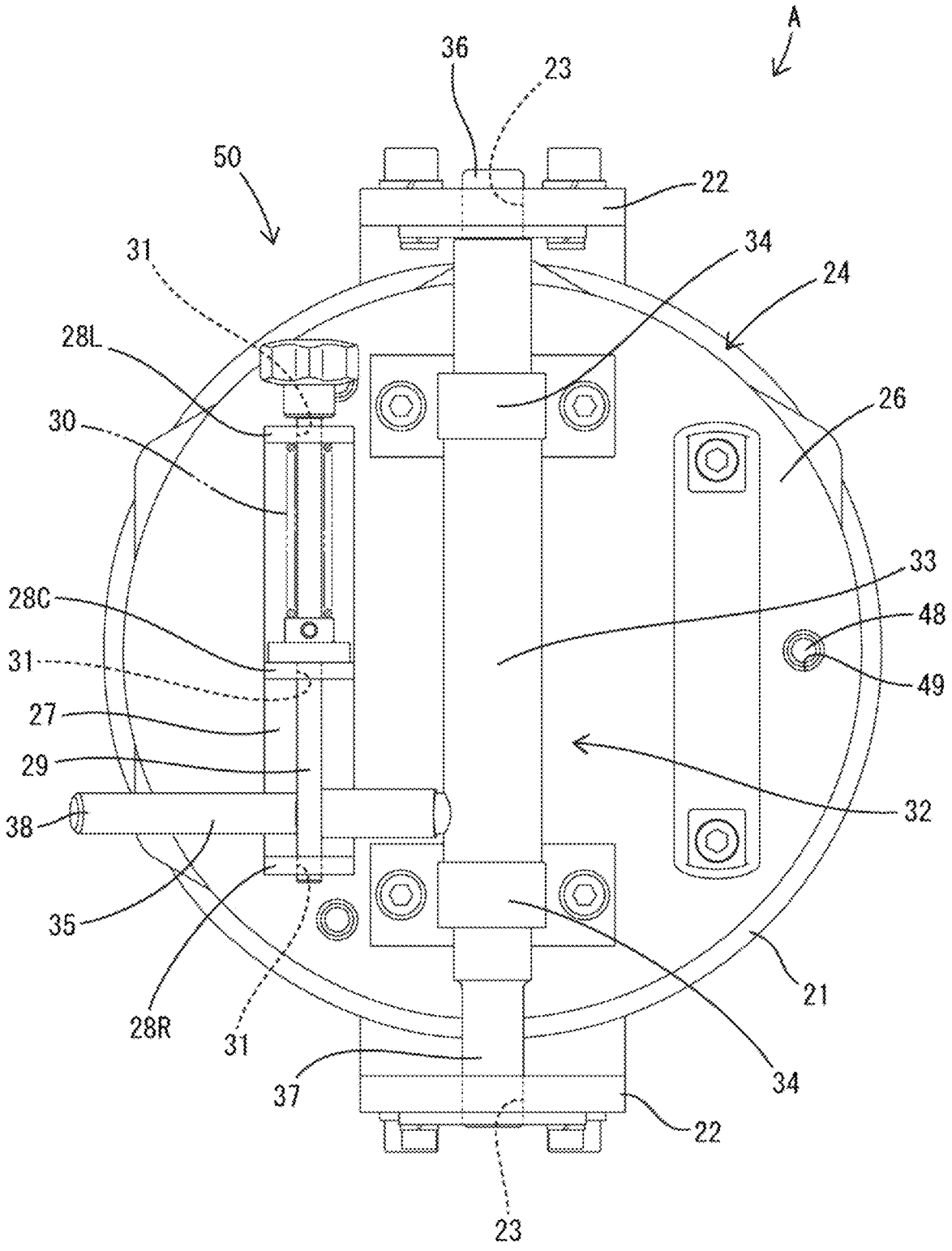
FIG. 7 is an enlarged plan view showing the state where the barrel lid is properly fixed to the rotary tank.
Figure 8:
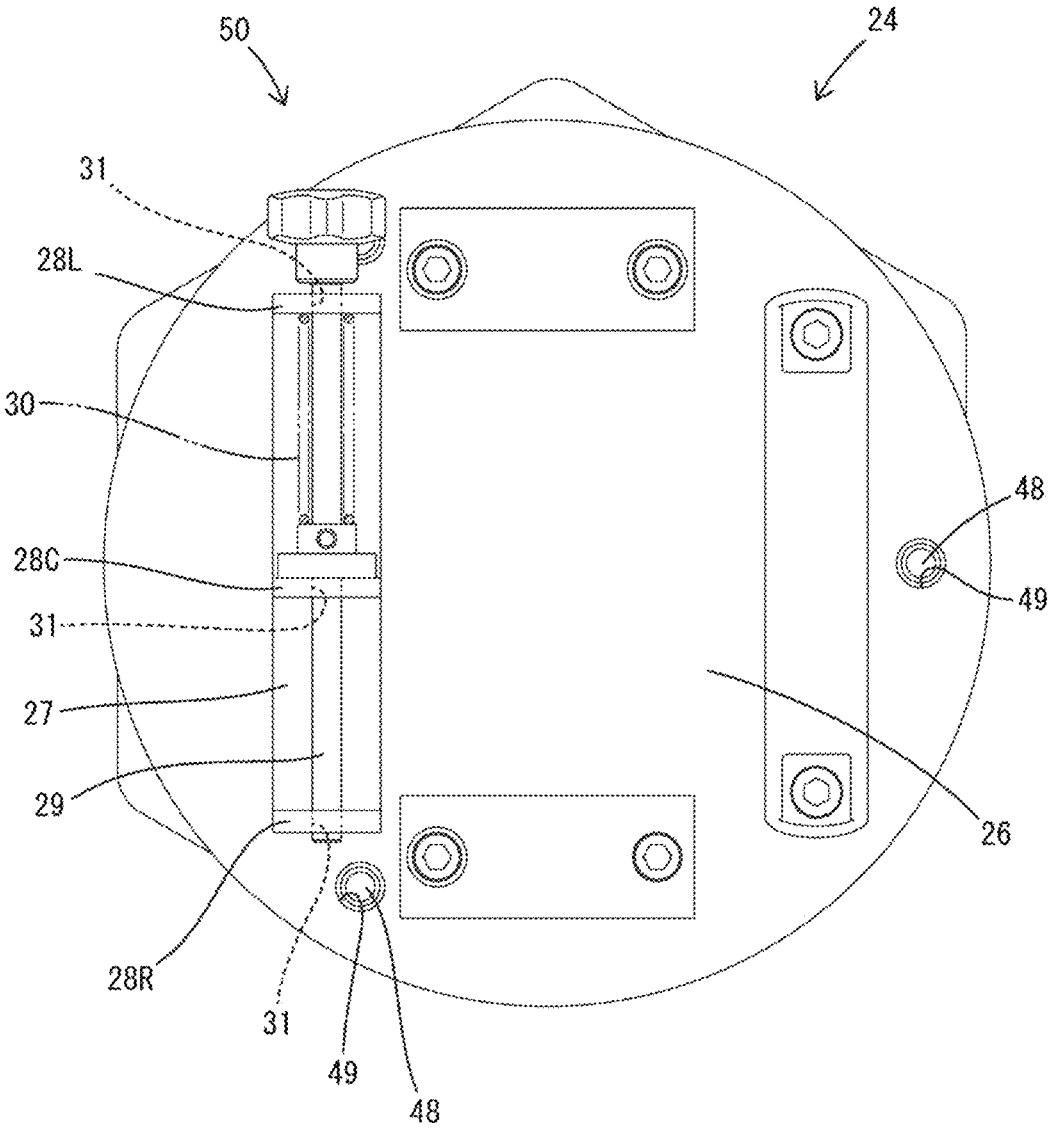
FIG. 8 is an enlarged plan view of the barrel lid.
Figure 9:
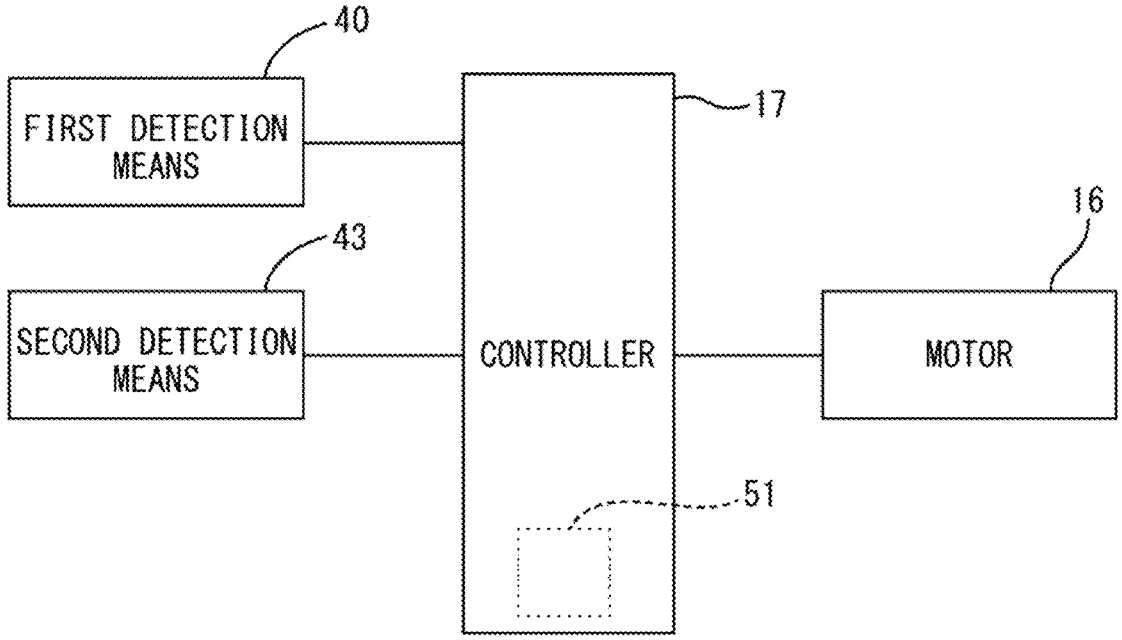
FIG. 9 is a block diagram showing the configuration of a means for detecting a fixation state of the barrel lid.

As shown in FIGS. 7 and 8, a support member 27 is firmly attached on an upper surface of the barrel lid 26 at an eccentric position from the center of the barrel lid 26 in the radial direction. The support member 27 is formed such that three support plates 281, 28C and 28R rising upward are arranged in parallel in the plate thickness direction of the support plates 281, 28C and 28R at predetermined intervals. Each of the support plates 28L, 28C and 28R is provided with a support hole 31 (see FIGS. 3 and 4) which penetrates therethrough in the parallel direction of the support plates 281, 28C and 28R (the horizontal direction). A stopper 29 having one rod shape is attached to the support member 27 in a state of penetrating the support holes 31. In a state where the barrel tank 24 is fixed to the barrel case 21, the stopper 29 is arranged in parallel to the clamp shaft 32.

The stopper 29 is always urged by a lock spring 30 toward a distal end side (rightward in FIG. 6, downward in FIGS. 7 and 8) and is held in a locked state. In the locked state, a proximal end (the left end) of the stopper 29 abuts on the left support plate 28L, and a distal end (the right end) of the stopper 29 penetrates the right support hole 31. When the stopper 29 is slid leftward against the urging force of the lock spring 30, the distal end of the stopper 29 is disengaged from the right support plate 28R.

As shown in FIGS. 3, 4, 6 and 7, the clamp shaft 32 is a single member in which one shaft main body 33, a pair of eccentric cams 34, and one lever 35 are integrated. As shown in FIG. 7, a shaft end 36 having a diameter smaller than that of the shaft main body 33 protrudes coaxially from the one end of the shaft main body 33. From the other end of the shaft main body 33, a small-diameter shaft part 37 having a diameter smaller than that of the shaft main body 33 and having a predetermined length extends coaxially.

The pair of eccentric cams 34 are formed at two positions spaced apart from each other in the axial direction of the shaft main body 33. The eccentric cams 34 each have a diameter larger than that of the shaft main body 33 and have a circular shape eccentric from the axial center of the shaft main body 33. The lever 35 is formed to extend radially outward in a cantilever manner from an outer periphery of the shaft main body 33 at a position on the small-diameter shaft part 37 side with respect to the axial center. The extending end of the lever 35 serves as a detected part 38 which can be detected by the second detection means 43. The lever 35 has both a function as an operation means for rotating the clamp shaft 32 and a function as a detection target of the second detection means 43.

The barrel tank 24 housed in the barrel case 21 is fixed to the barrel case 21 by the clamp shaft 32. When fixing the barrel tank 24, the clamp shaft 32 is first attached to the barrel case 21. At the time of the attachment, the small-diameter shaft part 37 of the clamp shaft 32 is deeply inserted into the one bearing hole 23 with the lever 35 protruding upward or obliquely upward, and then the shaft end 36 is inserted into the other bearing hole 23 while the clamp shaft 32 is being slid to the opposite direction. The clamp shaft 32 is thus attached to the barrel case 21.

Next, the stopper 29 is slid toward the proximal end side against the urge of the lock spring 30, and the distal end of the stopper 29 is pulled out from the support hole 31 of the right support plate 28R and retracted leftward further than the support plate 28R. Then, while the stopper 29 is kept in the retracted state, the lever 35 is gripped and operated to turn downward. This downward operation of the lever 35 causes the clamp shaft 32 to rotate with the bearing holes 23 as fulcrums, and pressing portions 34P, each of which is located farthest from the rotation center of the clamp shaft 32 on the outer periphery of the eccentric cam 34, to press an upper surface of the barrel tank 24 (the barrel lid 26) downward. By this pressing force, the barrel lid 26 is fixed to the barrel main body 25 (the rotary tank 50), and the barrel tank 24 as a whole is fixed to the barrel case 21.

The state where the detected part 38 of the lever 35 is thus positioned at the lowermost end, and the eccentric cams 34 press the upper surface of the barrel lid 26 so that the barrel lid 26 is fixed to the rotary tank 50 (that is, the state where the barrel tank 24 is fixed to the barrel case 21) is defined as a fixing form of the clamp shaft 32 (see FIGS. 3, 6 and 7). The position (the height) of the detected part 38 when the clamp shaft 32 is in the fixing form is defined as a fixing position.

Further, the state where the detected part 38 of the lever 35 is positioned at a releasing position which is above the fixing position, and fixation of the barrel lid 26 to the rotary tank 50 (the fixation of the barrel tank 24 to the barrel case 21) is incomplete or uncertain is defined as a releasing form of the clamp shaft 32 (see FIG. 4). Further, the state where the clamp shaft 32 is not attached to the barrel case 21 (the rotary tank 50) is also defined as a releasing form (not shown) of the clamp shaft 32.

The first detection means 40 is a means provided for the purpose of avoiding erroneous detection of the second detection means 43 by measuring an execution timing of detection by the second detection means 43. Specifically, the first detection means 40 detects whether the rotary tank 50 (the barrel case 21) is present within a predetermined detection area D (see FIGS. 1 and 2) set at one location on the revolution path of the rotary tank 50. The detection area D is set in a region on the opposite side of the first detection means 40 with the rotary shaft 13 interposed therebetween in a plan view. Detection signals of the first detection means 40 are output to the controller 17. The second detection means 43 detects whether, when any one of the rotary tanks 50 is present in the detection area D, the clamp shaft 32 is in the fixing form or in the releasing form with respect to the rotary tank 50.

As shown in FIGS. 1 and 2, the first detection means 40 includes four (equal in number to the barrel cases 21) first dogs 41 which correspond individually to the four rotary tanks 50 (four barrel cases 21), and one first proximity switch 42 which magnetically detects the approach of the first dogs 41. The four first dogs 41 are arranged along an outer peripheral edge of the turret 12 at an equal angular pitch of 90° in the circumferential direction, and rotate integrally with the turret 12. Each of the first dogs 41 is a rib-shaped protrusion protruding downward from the outer peripheral edge of the turret 12 in an arc shape, and has a certain length in the circumferential direction. In other words, each of the first dogs 41 has a form of being continuous in the revolution direction of the rotary tank 50 (the barrel case 21).

The first proximity switch 42 is arranged so as to horizontally face the rotation path of the first dog 41 from the outside in the radial direction (the outer peripheral side of the first dog 41). While the first dog 41 is close to the first proximity switch 42, a detection signal is output from the first proximity switch 42 to the controller 17. When the first proximity switch 42 detects the first dog 41 in the rotation process of the turret 12 (the revolution process of the rotary tanks 50), it is determined that the rotary tank 50 (the barrel case 21) corresponding to the detected first dog 41 is present in the detection area D. Here, since the first dog 41 has a certain length in the revolution path of the rotary tanks 50 (the barrel cases 21), a region with a certain range continuous along the revolution path of the rotary tanks 50 is set as the detection area D.

As shown in FIGS. 2 and 5, the second detection means 43 includes a light emitting unit 44 and a light receiving unit 45. The light emitting unit 44 and the light receiving unit 45 are arranged so as to face each other in the lateral direction with the detected part 38 (the lever 35) interposed therebetween, in a state where the rotary tank 50 is positioned in the detection area D and also the detected part 38 (the lever 35) of the clamp shaft 32 of the rotary tank 50 is positioned at the fixing position or in the vicinity of the fixing position. The facing direction of the light emitting unit 44 and the light receiving unit 45 is almost orthogonal to the turning direction of the detected part 38 in a region near the fixing position in the turning path of the detected part 38 between the fixing position and the releasing position (generally the vertical direction). Further, the facing direction of the light emitting unit 44 and the light receiving unit 45 in a plan view is generally parallel to the tangential direction at a circumferential central part within the detection area D in the revolution path of the rotary tanks 50 (the barrel cases 21).

As shown in FIGS. 3 and 4, the light emitting unit 44 has a linear light source 46 that is elongated in the vertical direction. As shown in FIGS. 2 and 5, the linear light source 46 (the light emitting unit 44) is configured to emit a band-shaped laser light 47 (detection light set forth in the claims). The width direction of the laser light 47 is almost parallel to the turning direction of the detected part. 38 in the region near the fixing position in the turning path of the detected part 38 (generally the vertical direction). An upper end of the emission range of the laser light 47 is set to be higher than an upper end of the detected part 38 when the detected part 38 is positioned above the fixing position. A lower end of the emission range of the laser light 47 is set to be lower than a lower end of the detected part 38 when the detected part 38 is positioned at the fixing position.

The light receiving unit 45 receives all of the laser light 47 emitted from the light emitting unit 44 and having arrived without being blocked by any other member. The light receiving unit 45 detects a light reception range, in the width direction (the vertical direction), of the laser light 47. Specifically, a ratio between a light emission region in the width direction of the laser light 47 emitted from the light emitting unit 44 and a light reception region in the width direction of the laser light 47 received by the light receiving unit 45 is detected.

The detection information of the light reception region in the light receiving unit 45 is output from the second detection means 43 to the controller 17 in order to decide a fixation state of the barrel lid 26 by the clamp shaft 32. The controller 17 decides whether the clamp shaft 32 is in the fixing form or in the releasing form, based on the detection information of the light reception region which is output from the second detection means 43.

Furthermore, the first detection means 40 is also a means having a function of detecting whether the second detection means 43 has properly executed detection on all of the four rotary tanks 50, in order to avoid erroneous detection by the second detection means 43. Specifically, when the detection by the first detection means 40 is executed at least four times, it is thereby detected that the detection by the second detection means 43 has been surely executed once for every rotary tank 50.

Next, the action and effect of Example 1 will be described. The four barrel tanks 24 into which masses have been charged are housed in the barrel cases 21 and fixed by the clamp shafts 32, respectively. As a result, all the barrel lids 26 are fixed to the rotary tanks 50, respectively. After proper fixation of all the barrel tanks 24 to the barrel cases 21, a detection step of detecting a fixation state of the clamp shafts 32 is executed while rotating the turret 12. After the detection step, the process shifts to the barrel polishing step without stopping the turret 12. Hereinafter, control procedures in the detection step will be described with reference to the flowchart in FIG. 10.

After fixation of all the barrel lids 26 to the rotary tanks 50, the turret 12 is rotated at a low speed (step S101), and the detection signal from the first detection means 40 is output to the controller 17. For initialization, the controller 17 decides whether any one of the rotary tanks 50 and the barrel lids 26 (the barrel cases 21 and barrel tanks 24) is present in the detection area D (step S102).

That is, in the case where any one of the rotary tanks 50 is positioned in the detection area D at the front end in the revolution direction when the detection by the first detection means 40 is executed, there is a possibility that the detected part 38 may have deviated from an optical path of the laser light 47. In this case, the rotary tank 50 goes outside the detection area D without proper execution of the detection by the second detection means 43. Therefore, initialization is performed in order to avoid such erroneous detection. That is, it is confirmed that none of the rotary tanks 50 is present in the detection area D (that is, the rotary tanks 50 are present outside the detection area D).

After it is decided that none of the rotary tanks 50 is present in the detection area D, it is decided whether any one of the rotary tanks 50 has entered the detection area D (step S103). When any one of the rotary tanks 50 has entered the detection area D, the detection by the second detection means 43 is executed (step S104). The laser light. 47 is constantly emitted from the light emitting unit 44. Upon execution of first detection by the second detection means 43, the controller 17 starts the operation of a timer 51. The time required for one rotation of the turret 12 has been set in the timer 51 in consideration of the rotation speed of the turret 12.

Here, the rotation shaft 13 rotating integrally with the rotary tank 50 has been set such that the rotation cycle and the revolution cycle are identical with each other. Therefore, when the barrel case 21 is positioned in the detection area D, the rotary tank 50 always faces a specific direction in the circumferential direction around the rotation shaft 18. Accordingly, the orientations of the clamp shaft 32 (the lever 35) and the support member 27 which are provided in the rotary tank 50 so as to be integrally rotatable are also always fixed (the orientation in which the support member 27 is positioned in front of the clamp shaft 32).

When the rotary tank 50 (the barrel case 21) is positioned in the detection area D and the clamp shaft 32 is in the fixing form, the lever 36 is in a state of extending generally horizontally from the shaft main body 33 to the front side, and the detected part 38 is positioned at the fixing position which overlaps the optical path of the laser light 47. As a result, the laser light 47 is partially blocked by the detected part 38, and a region of the laser light 47 blocked by the detected part 38 is not received by the light receiving unit 45. From the second detection means 43, a proportion of the light reception range in the width direction of the laser light 47 in the light receiving unit 45 to the light emission region in the width direction of the laser light 47 in the light emitting unit 44 is input to the controller 17.

In the controller 17, a threshold value has been set in advance regarding the light reception range of the laser light 47 in the light receiving unit 45, and the detection signal from the second detection means 43 is compared with the threshold value, and thereby it is decided whether the detected part 38 is present at the fixing position or not (that is, whether the clamp shaft 32 is in the fixing form or in the releasing form). Then, the number of times of decision that the clamp shaft 32 is in the fixing form (the detected part 38 is present at the fixing position and the fixation state of the barrel lid 26 is proper) is integrated (step S105).

If the number of times of decision that the clamp shaft 32 is in the fixing form is less than 4 (which is equal to the number of the rotary tanks 50), it is decided whether the timer 51 has finished counting (step S106). When it is decided that the timer 51 has not finished counting (that is, the turret 12 has not rotated one revolution), it means that the detection by the second detection means 43 has not been completed for all of the four rotary tanks 50; therefore, the detection by the first detection means 40 (step S103) and the detection by the second detection means 43 (step S104) are repeated again.

When the detection of the first detection means 40 and the detection of the second detection means 43 are repeated, and the number of times of decision that the clamp shaft 32 is displaced to the fixing form reaches 4 (step S105), the rotation speed of the turret 12 is switched from the low speed to a high speed without stopping the turret 12 (step S107). Even when the number of rotations of the turret 12 has not reached 1, the rotation speed of the turret 12 is switched from the low speed to a high speed when the number of times of decision that the clamp shaft 32 is displaced to the fixing form has reached 4.

When the turret 12 is switched to the high speed rotation state, the centrifugal barrel polishing machine A shifts to the barrel polishing step. During barrel polishing, the polishing time is counted (step S108). After the elapse of a predetermined polishing time, the turret 12 stops (step S109). Thus, the detection step of the fixation state by the clamp shaft 32 and the barrel polishing step are executed without stopping the turret 12.

When any one of the four barrel lids 26 is not properly fixed to the rotary tank 50, that is, any one of the four barrel tanks 24 is not properly fixed to the barrel case 21, the turret 12 stops without shifting to barrel polishing, and the detection step of the fixation state ends. The procedures will be described below.

When the turret 12 is rotated at a low speed (step S101), and the detection signal from the first detection means 40 is output to the controller 17, the controller 17 decides whether any one of the rotary tanks 50 is present in the detection area D (step S102). After it is decided that none of the rotary tanks 50 is present in the detection area D, it is decided whether any one of the rotary tanks 50 has entered the detection area D (step S103). When any one of the rotary tanks 50 has entered the detection area D, the detection by the second detection means 43 is executed (step S104).

The controller 17 decides whether the detected part 38 is present at the fixing position or not (that is, whether the clamp shaft 32 is in the fixing form or in the releasing form), and the number of times of decision that the clamp shaft 32 is in the fixing form (the detected part 38 is present at the fixing position) is integrated (step S105). If the number of times of decision that the clamp shaft 32 is in the fixing form is less than 4 (which is equal to the number of the rotary tanks 50), it is decided whether the timer 51 has finished counting (step S106).

Here, when it is decided that the timer 51 has finished counting (that is, the turret 12 has rotated one revolution), the decision means that, although the turret 12 has rotated one revolution (i.e., the fixation state of the barrel lid 26 has been detected for all of the four rotary tanks 50), the number of the rotary tanks 50 decided to have the clamp shaft 32 being in the fixing form is 3 or less. That is, it means that the fixation state of the barrel lid 26 is not proper in any of the rotary tanks 50. Therefore, when it is decided that the timer 51 has finished counting, the rotation of the turret 12 is stopped without shifting to the barrel polishing step (step S109). After that, the operation for fixing the barrel lid 26 will be performed again on the rotary tank 50 to which the barrel lid 26 is not properly fixed, and the detection step described above will be executed again.

The centrifugal barrel polishing machine A according to Example 1 includes the rotatable turret 12, four rotary tanks 50, four barrel lids 26 that are individually attachable to and detachable from the four rotary tanks 50, four clamp shafts 32, the first detection means 40, and the second detection means 43. The rotary tanks 50 are provided at eccentric positions of the turret 12 and planetarily rotate with the rotation of the turret 12. The clamp shafts 32 are provided individually in the four rotary tanks 50 (the barrel cases 21) so as to planetarily rotate integrally with the rotary tanks 50 (the barrel cases 21).

Each of the clamp shaft 32 is displaceable between in the fixing form for fixing the barrel lid 26 attached to the rotary tank 50 (the fixing form for fixing the barrel tank 24 housed in the barrel case 21) and in the releasing form for releasing the fixation of the barrel lid 26 to the rotary tank 50 (the fixation of the barrel tank 24 to the barrel case 21). The first detection means 40 detects whether the rotary tank 50 is positioned in the detection area D set on the revolution path of the rotary tank 50 (the barrel case 21). The second detection means 43 detects whether the clamp shaft 32 of the rotary tank 50 positioned in the detection area D is displaced to the fixing form.

According to this configuration, whether the barrel lid 26 is fixed to the rotary tank 50 (that is, whether the barrel tank 24 is fixed to the barrel case 21) can be determined based on the detection result of the second detection means 43 when the rotary tank 50 is positioned in the detection area D. Since the first detection means 40 for detecting whether the rotary tank 50 (the barrel case 21) is positioned in the detection area D is provided, the barrel lids 26 attached to all the rotary tanks 50 can be detection targets of the second detection means 43. As a result, it is possible to avoid the detection by the second detection means 43 being overlooked. Therefore, the detection as to whether the barrel lid 26 is fixed to the rotary tank 50 can reliably be executed for all the barrel lids 26 (i.e., whether all the barrel tanks 24 are fixed to the barrel cases 21).

Further, before barrel polishing, the fixation state of the barrel lid 26 (the barrel tank 24) is confirmed in the process of rotating the turret 12 at least by ¾ revolution and at most by one revolution. In this confirmation process, the rotation of the turret 12 is configured to be stopped on the condition that the second detection means 43 has detected that the clamp shaft 32 provided in at least one of the rotary tanks 50 among the four (plurality of) rotary tanks 50 is not displaced to the fixing form.

According to this configuration, when it is detected that at least one of the four barrel lids 26 is not fixed, the rotation of the turret 12 is stopped before shifting to the barrel polishing step. Thus, it is possible to prevent barrel polishing from being executed in a state where the barrel lid 26 is not properly fixed. Improper fixation of the barrel lid 26 is detected before execution of barrel polishing, so that it is possible to prevent damages to the centrifugal barrel polishing machine and generation of defective polishing products (workpieces) due to improper fixation of the barrel lid 26.

Further, since the detection area D is set continuously in an arc shape along the revolution direction of the rotary tank 50 (the barrel case 21), the detection target range of the second detection means 43 is broad. Therefore, detection by the second detection means 43 can be performed while the rotary tank 50 (the barrel tank 24) is being revolved, even if there is a variation in the position of the rotary tank 50 on the turret 12 in the revolution direction or in the attachment position of the clamp shaft 32 in the rotary tank 50.

Further, the second detection means 43 has the light emitting unit 44 chat irradiates the clamp shaft 32 with the laser light 47 (the detection light) in parallel to the tangential direction of the revolution path of the rotary tank 50 (the barrel case 21). According to this configuration, the displacement amount of the clamp shaft 32 (the detected part 38) which revolves integrally with the rotary tank 50 (the barrel case 21) is small, and thus the positional deviation of the clamp shaft 32 (the detected part 38) with respect to the laser light 47 is small, on the projection plane orthogonal to the irradiation direction of the detection light (the plane appearing in FIGS. 3 and 4). Therefore, the detection by the second detection means 43 can be performed with high accuracy. Further, because of high directivity of the laser light 47, it is possible to prevent erroneous detection due to irradiation with the detection light to a member other than the clamp shaft 32.

Further, the displacement direction of the clamp shaft 32 (the detected part 38) between in the fixing form and in the releasing form (generally the vertical direction) may be a direction intersecting the irradiation direction of the laser light 47 (the lateral direction). According to this configuration, the displacement amount of the clamp shaft 32 (the detected part 38) between in the fixing form and in the releasing form is large on the projection plane orthogonal to the irradiation direction of the detection light (the plane appearing in FIGS. 3 and 4). Therefore, the detection by the second detection means 43 can be performed with high accuracy.

Further, the light emitting unit 44 has the linear light source 46 along the displacement direction of the detected part 38 when the detected part 38 of the clamp shaft 32 moves around the fixing position and the vicinity thereof. According to this configuration, the detection by the second detection means 43 can be performed with high accuracy, even if there is a variation in the displacement position of the clamp shaft 32 (the detected part 38) in the fixing form.

Further, the clamp shaft 32 is configured to be displaced (rotated around the axis) at an eccentric position with respect to the rotation shaft 18 of the rotary tank 50 (the barrel case 21). The rotation cycle of the rotary tank 50 is an integral multiple of the revolution cycle of the rotary tank 50. According to this configuration, the clamp shaft 32 (the detected part 38 of the lever 35) of every rotary tank 50 always faces a specific direction (a fixed direction) when the rotary tank 50 (the barrel case 21) is positioned in the detection area D, regardless of the number of rotations of the turret 12. Therefore, it is not necessary to adjust the orientation of the rotary tank 50 or the clamp shaft 32 when detection by the second detection means 43 is performed.

Example 2

Next, Example 2 that embodies the present invention will be described with reference to FIGS. 11 to 15. In the following description, with regard to the longitudinal direction, the left side in FIGS. 11, 13 and 14 and the upper side in FIG. 12 are defined as a front side. With respect to the vertical direction, the orientations appearing in FIGS. 11, and 13 to 15 are defined as upper and lower sides as they are. With respect to the lateral direction, the orientations appearing in FIGS. 12 and 15 are defined as left and right sides as they are.

A centrifugal barrel polishing machine B according to Example 2 has a form different from that of Example 1 in terms of rotary tanks 56 and orientation of the axis of the rotation center (the rotary shaft 53) of the rotary tanks 56. Since the other components are the same as those of Example 1, the same reference numerals are given to the same components, and the descriptions of the structure, action and effect thereof are omitted.

As shown in FIG. 12, the centrifugal barrel polishing machine B includes a pair of left and right bases (not shown) housed in a housing (not shown), a rotary shaft 53, a pair of left and right turrets 54, four (a plurality of) rotary tanks 56, four (a plurality of) barrel lids 59, clamp shafts. 66 (a fixation means set forth in the claims), a first detection means 40 (see FIG. 11), and a second detection means 43 (see FIG. 12). The rotary shaft 53 is housed in the housing and is rotatably supported on the base with the axis of the rotary shaft 53 oriented in the lateral direction (the horizontal direction). The pair of left and right turrets 54 are housed in the housing. The four (plurality of) rotary tanks 56 are attached to the pair of turrets 54. The four (plurality of) barrel lids 59 are individually attached to the four rotary tanks 56. Each of the clamp shafts 66 is a member for fixing the barrel lid 59 to the rotary tank 56. The first detection means 40 and the second detection means 43 are provided inside the housing.

The centrifugal barrel polishing machine B has a function of detecting whether the barrel lid 59 is properly fixed to the rotary tank 56 prior to a barrel polishing step. When it is detected that all the barrel lids 59 are properly fixed to the rotary tanks 56, the process shifts from the detection step to barrel polishing. When it detects that at least any one of the four barrel lids 59 is not properly fixed to the rotary tank 56, the rotation of the turrets 54 is stopped without shifting to barrel polishing. In the barrel polishing process, the four (plurality of) barrel tanks 60 are planetarily rotated about the horizontal rotary shaft 53 and rotation shafts 55 to polish workpieces (not shown) charged in the barrel tanks 60.

Next, the structure of the centrifugal barrel polishing machine B will be described. The rotary shaft 53 is connected to a motor 16 (see FIG. 9 of Example 1) via a drive mechanism (not shown). Control of drive and stop of the motor 16 and control of the rotation speed of the motor 16 are performed by a controller 17 (see FIG. 9 of Example 1). The controls by the controller 17 are performed based on detection signals from the first detection means 40 and the second detection means 43 and the operation of a timer 51. The controller 17, first detection means 40, second detection means 43 and timer 51 have the same functions as in Example 1.

The turrets 54 are each concentrically attached to the rotary shaft 53 so as to be rotatable integrally therewith. Four eccentric positions eccentric in the radial direction from the rotary shaft 53 are set on the respective turrets 54 at an equal angular pitch of 90° on the same circumference which is concentric with the rotary shaft 53. At each of the eccentric positions, the rotation shaft 55 parallel to the rotary shaft 53 is attached so as to be rotatable relatively to the turrets 54 (i.e., so as to be planetarily rotatable).

The rotation shaft 55 is connected to the rotary shaft 53 via a rotation force transmission mechanism (not shown). Accordingly, when the turrets 54 rotate integrally with the rotary shaft 53, the rotation force of the rotary shaft 53 is transmitted to the four rotation shafts 55, and the four rotation shafts 55 rotate relatively to the turrets 54. The rotation cycle of the rotation shafts 55 is the same as the revolution cycle of the rotation shafts 55 (that is, rotation cycles of the turrets 54 and the rotary shaft 53). The rotation direction of the rotation shafts 55 in a side view is opposite to the revolution direction of the rotation shafts 55 (the rotation directions of the turrets 54 and the rotary shaft 53).

Figure 11:
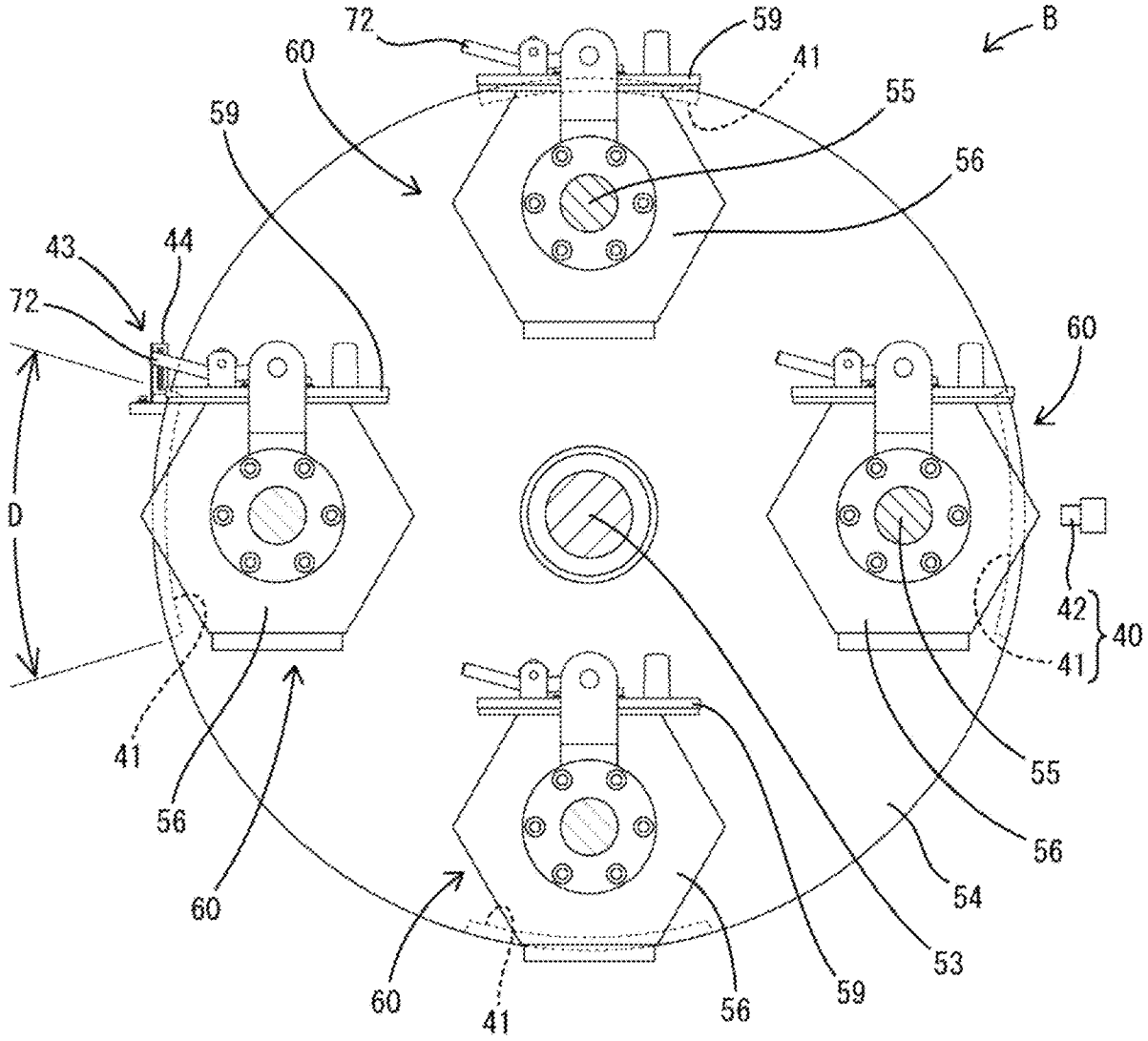
FIG. 11 is a side sectional view of a centrifugal barrel polishing machine of Example 2.
Figure 12:
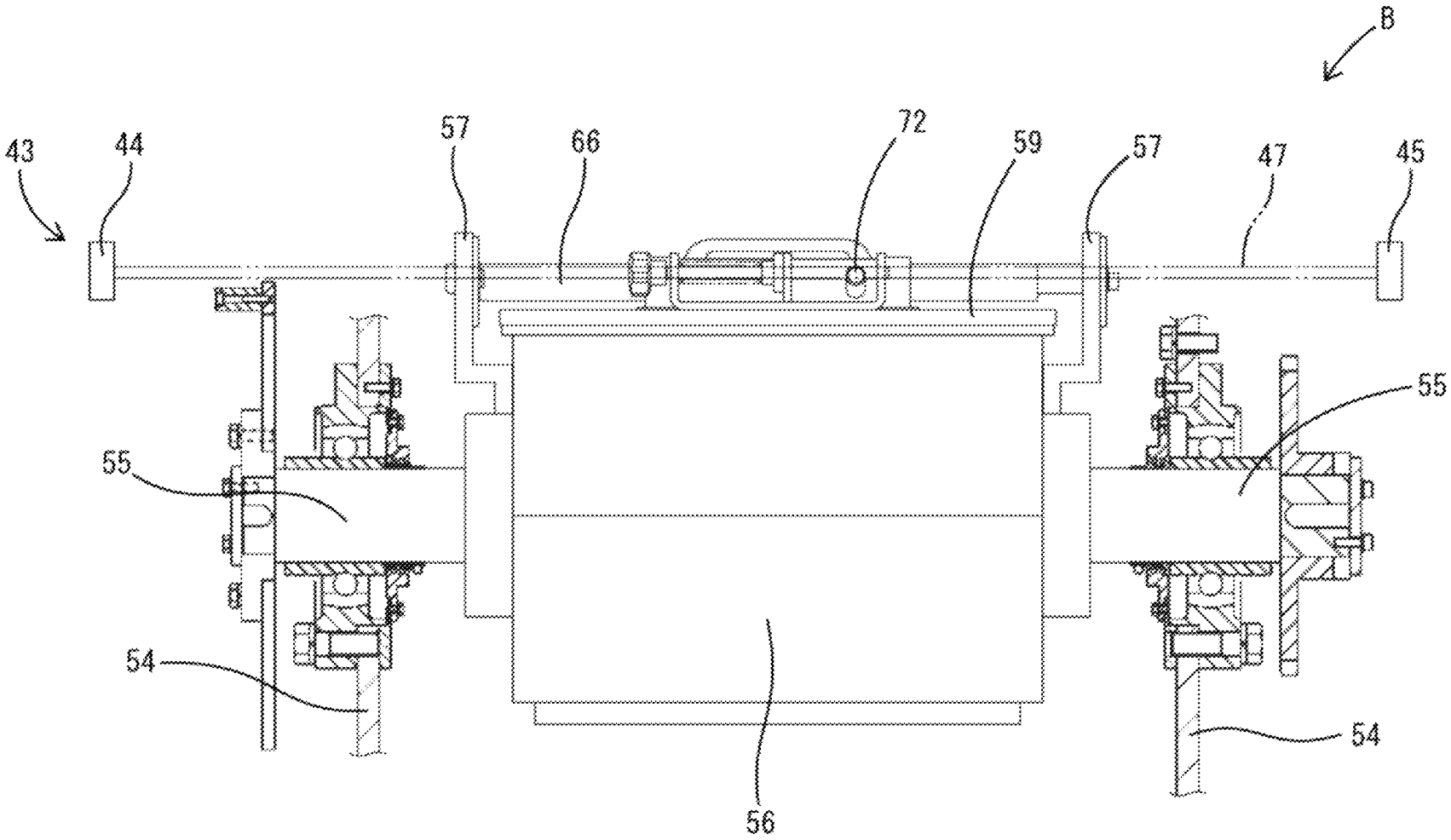
FIG. 12 is a front sectional view of the centrifugal barrel polishing machine.
Figure 13:
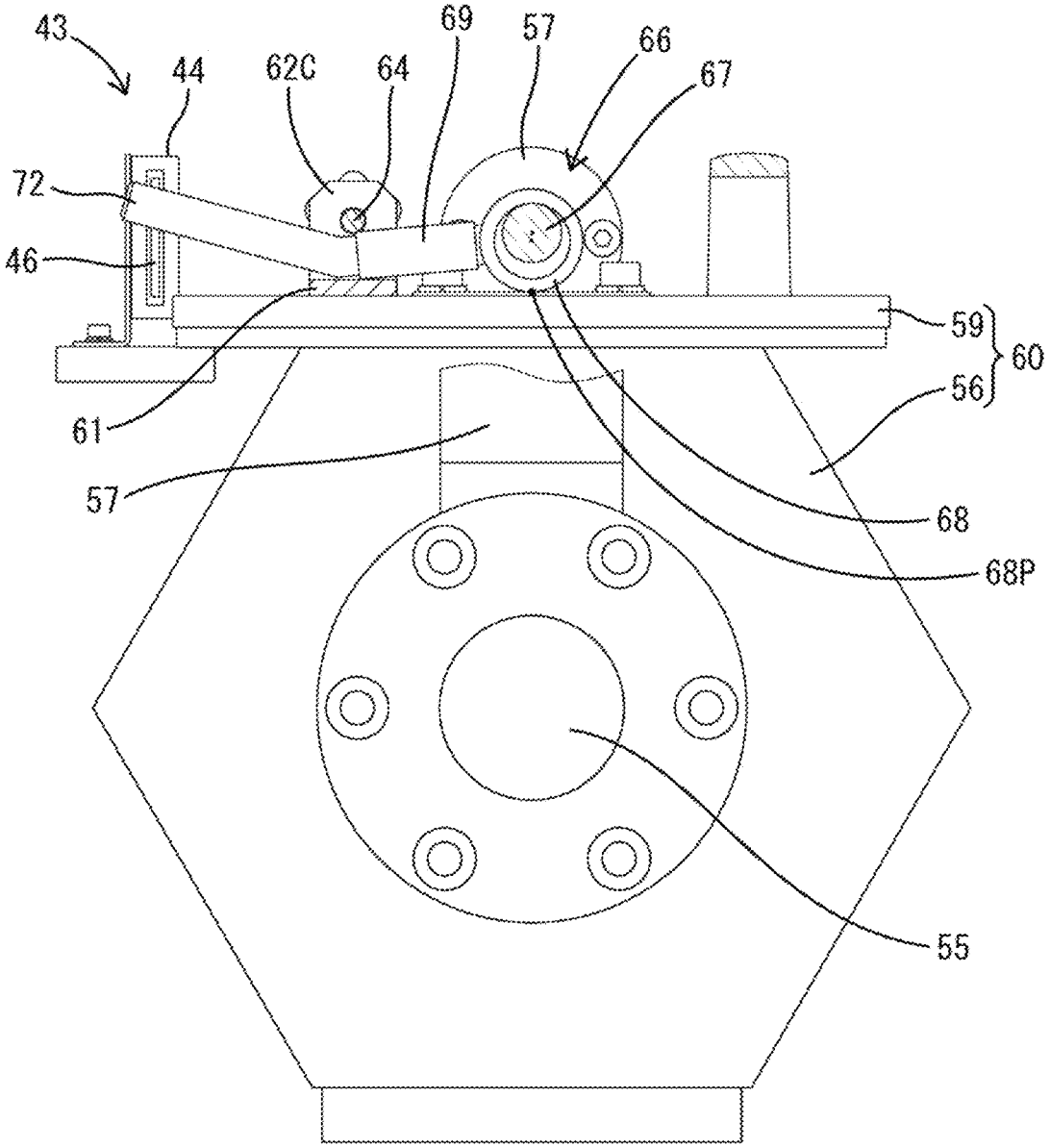
FIG. 13 is an enlarged side sectional view showing a state where a barrel lid is properly fixed to a rotary tank.
Figure 14:
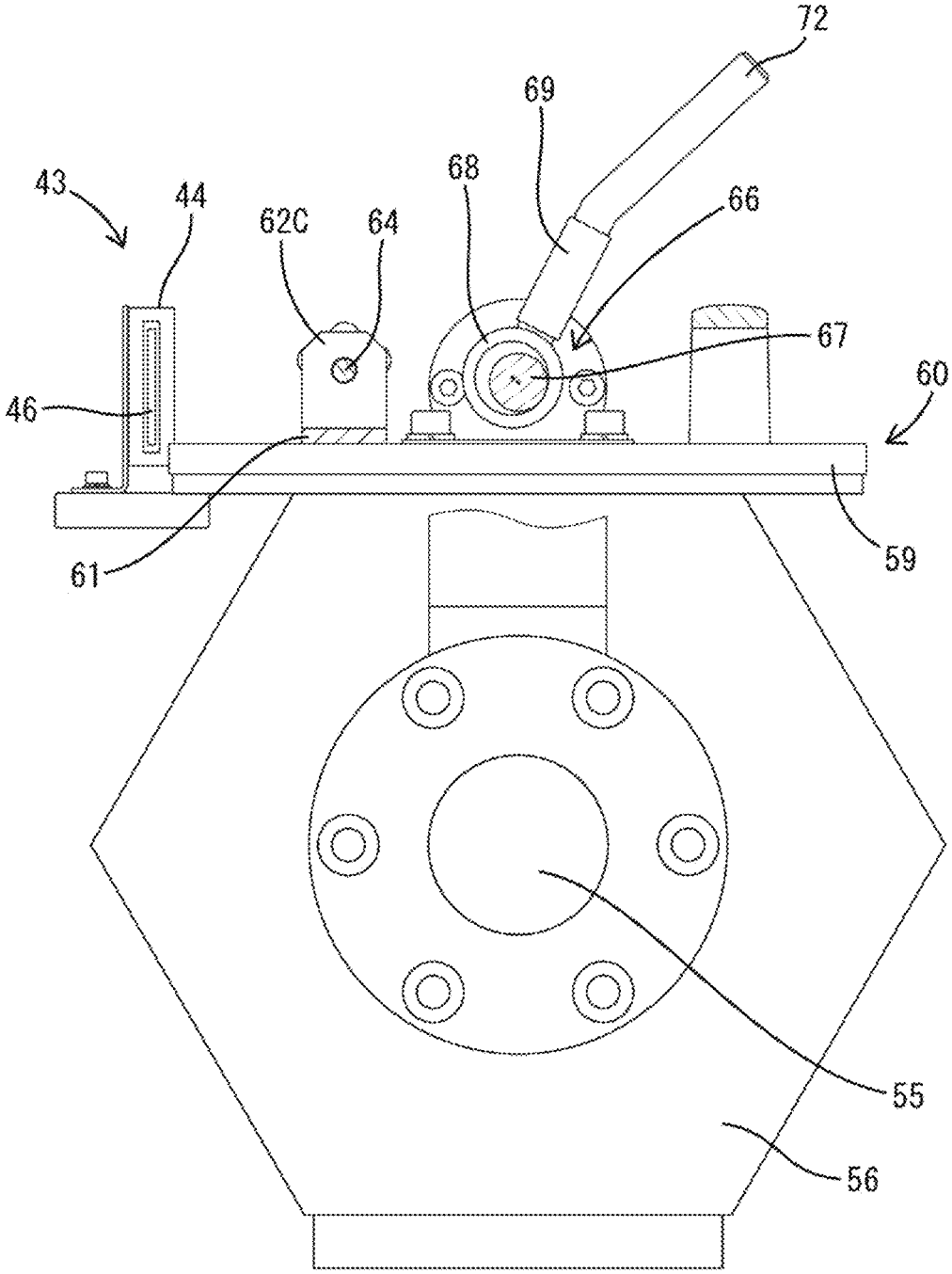
FIG. 14 is an enlarged side sectional view showing a state where the barrel lid is not properly fixed to the rotary tank.
Figure 15:
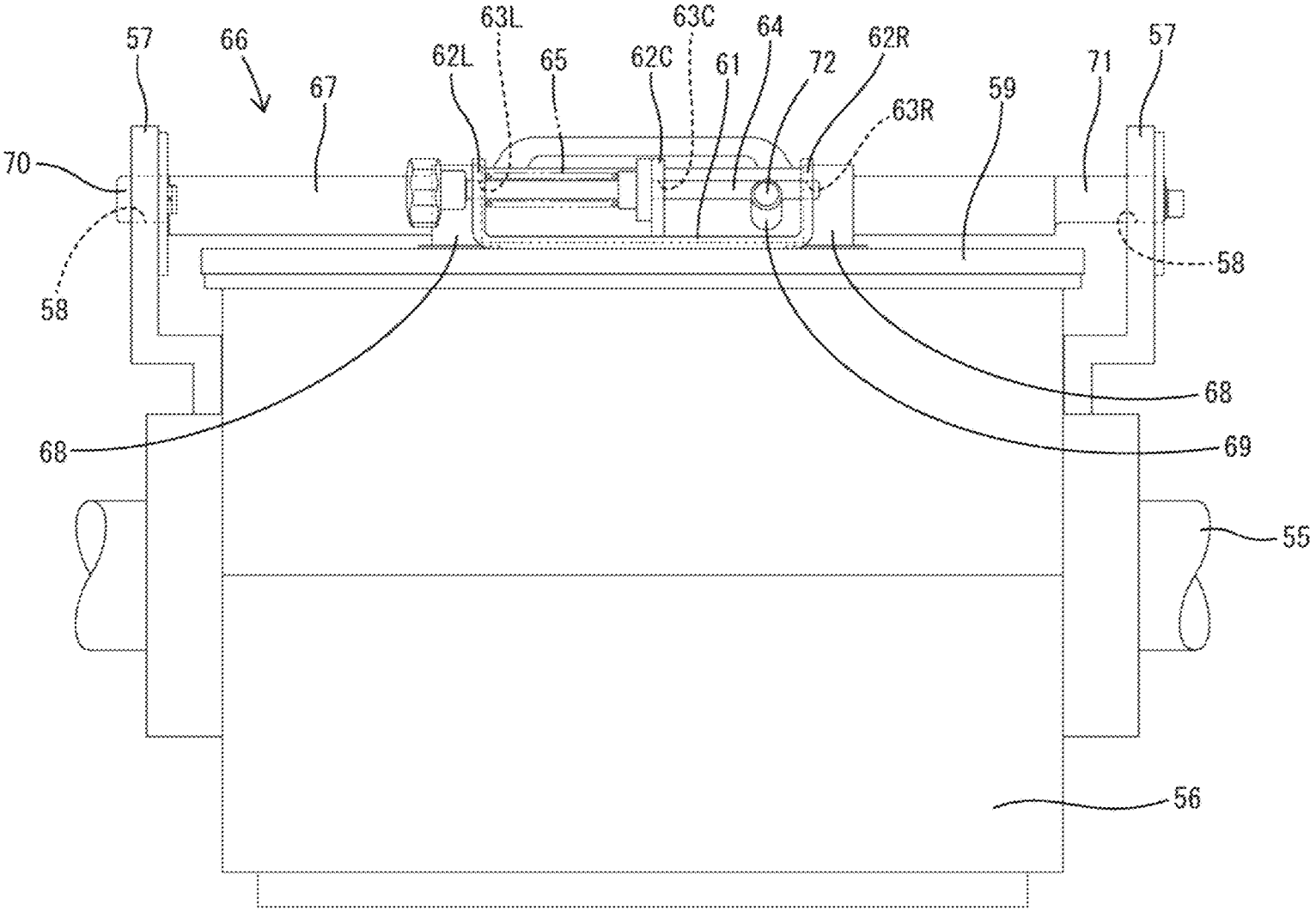
FIG. 15 is an enlarged front view showing the state where the barrel lid is properly fixed to the rotary tank.

As shown in FIGS. 11, 13 and 14, the rotary tank 56 has a box shape having a substantially regular hexagonal shape in a side view, and an outer periphery of the rotary tank 56 is composed of six substantially rectangular outer surfaces. One of the six outer surfaces is open as an opening (not shown) for charging/discharging masses (workpieces and polishing stones). The rotary tank 56 has a pair of left and right side walls, and the outer surfaces of both the side walls are firmly attached to the pair of rotation shafts 55 so as to be rotatable integrally therewith. As shown in FIG. 15, a pair of bearing members 57 in the form of rising in the same direction as the opening direction of the opening (upward in FIG. 15) are firmly attached to the side walls of the rotary tank 56. A bearing hole 58 penetrating in the lateral direction (the horizontal direction) is formed at a protruding end portion of each of the bearing members 57.

The barrel lid 59 has a substantially rectangular shape and is attached to the rotary tank 56 so as to close the opening. The barrel lid 59 is attached to the rotary tank 56, thereby forming the barrel tank 60. As shown in FIGS. 13 and 14, a support member 61 is firmly attached on an outer surface of the barrel lid 59 at an eccentric position from the widthwise center of the barrel lid 59. As shown in FIG. 15, three support plates 621, 62C and 62R rise upward from the support member 61. The three support plates 62L, 62C and 62R are arranged in parallel in the place thickness direction thereof at predetermined intervals.

The support plates 62L, 62C and 62R are respectively provided with support holes 63L, 63C and 63R which penetrate therethrough in the parallel direction of the support plates 62L, 62C and 62R (the horizontal direction). A stopper 64 having one rod shape is attached to the support member 61 in a state of penetrating the support holes 63L, 63C and 63R. In a state where the barrel lid 59 is fixed to the rotary tank 56, the stopper 64 is arranged in parallel to the clamp shaft 66.

The stopper 64 is always urged by a lock spring 65 toward a distal end side (rightward in FIG. 15) and is held in a locked state. In the locked state, a proximal end (the left end) of the stopper 64 abuts on the left support plate 621, and a distal end (the right end) of the stopper 64 penetrates the right support hole 63R. When the stopper 64 is slid leftward against the urging force of the lock spring 65, the distal end of the stopper 64 is disengaged from the right support plate 62R.

As shown in FIGS. 13 to 15, the clamp shaft 66 is a single member in which one shaft main body 67, a pair of eccentric cams 68, and one lever 69 are integrated. As shown in FIG.

15, a shaft end 70 having a diameter smaller than that of the shaft main body 67 protrudes coaxially from the one end of the shaft main body 67. From the other end of the shaft main body 67, a small-diameter shaft part 71 having a diameter smaller than that of the shaft main body 67 and having a predetermined length extends coaxially.

The pair of eccentric cams 68 are formed at two positions spaced apart from each other in the axial direction of the shaft main body 67. The eccentric cams 68 each have a diameter larger than that of the shaft main body 67 and have a circular shape eccentric from the axial center of the shaft main body 67. The lever 69 is formed to extend radially outward in a cantilever manner from an outer periphery of the shaft main body 67 at a position on the small-diameter shaft part 71 side with respect to the axial center. The extending end of the lever 69 serves as a detected part 72 which can be detected by the second detection means 43. The lever 69 has both a function as an operation means for rotating the clamp shaft 66 and a function as a detection target of the second detection means 43.

The barrel lid 59 is attached to the rotary tank 56 in which the bearing members 57 protrude upward, so as to close the opening of the rotary tank 56, and is fixed to the rotary tank 56 by the clamp shaft 66. When fixing the barrel lid 59, the clamp shaft 66 is first attached to the rotary tank 56. At the time of the attachment, the small-diameter shaft part 71 of the clamp shaft 66 is deeply inserted into the one bearing hole 58 with the lever 69 protruding upward or obliquely upward, and then the shaft end 70 is inserted into the other bearing hole 58 while the clamp shaft 66 is being slid to the opposite direction. The clamp shaft 66 is thus attached to the rotary tank 56.

Next, the stopper 64 is slid toward the proximal end side against the urge of the lock spring 65, and the distal end of the stopper 64 is pulled out from the support hole 63R of the right support plate 62R and retracted leftward further than the support plate 62R. Then, while the stopper 64 is kept in the retracted state, the lever 69 is gripped and operated to turn downward. This downward operation of the lever 69 causes the clamp shaft 66 to rotate with the bearing holes 58 as fulcrums, and pressing portions 68P, each of which is located farthest from the rotation center of the clamp shaft 66 on the outer periphery of the eccentric cam 68, to press an upper surface of the barrel lid 59 downward. By this pressing force, the barrel lid 59 is fixed to the rotary tank 56.

The state where the detected part 72 of the lever 69 is thus positioned at the lowermost end, and the eccentric cams 68 press the upper surface of the barrel lid 59 so that the barrel lid 59 is fixed to the rotary tank 56 is defined as a fixing form of the clamp shaft 66 (see FIGS. 12, 13 and 15). The position (the height) of the detected part 72 when the clamp shaft 66 is in the fixing form is defined as a fixing position.

Further, the state where the detected part 72 of the lever 69 is positioned at a releasing position which is above the fixing position, and fixation of the barrel lid 59 to the rotary tank 56 is incomplete or uncertain is defined as a releasing form of the clamp shaft 66 (see FIG. 14). Further, the state where the clamp shaft 66 is not attached to the rotary tank 56 is also defined as a releasing form (not shown) of the clamp shaft 66.

The first detection means 40 is a means provided for the purpose of avoiding erroneous detection of the second detection means 43 by measuring an execution timing of detection by the second detection means 43 Specifically, the first detection means 40 detects whether the rotary tank 56 is present within a predetermined detection area D (see FIG. 11) set at one location on the revolution path of the rotary tank 56. The detection area D is set in a region on the opposite side of the first detection means 40 with the rotary shaft 53 interposed therebetween in a plan view (almost at the same height as the rotary shaft 53 and in front of the rotary shaft 53). Detection signals of the first detection means 40 are output to the controller 17. The second detection means 43 detects whether, when any one of the rotary tanks 56 is present in the detection area D, the clamp shaft 66 is in the fixing form or in the releasing form with respect to the rotary tank 56.

As shown in FIG. 11, the first detection means 40 includes four (equal in number to the rotary tanks 56) first dogs 41 which correspond individually to the four rotary tanks 56, and one first proximity switch 42 which magnetically detects the approach of the first dogs 41. The four first dogs 41 are arranged along an outer peripheral edge of the one of the turrets 54 at an equal angular pitch of 90° in the circumferential direction, and rotate integrally with the turrets 54. Each of the first dogs 41 is a rib-shaped protrusion protruding from the outer peripheral edge of the turrets 54 toward the axial direction of the rotary shaft 53 in an arc shape, and has a certain length in the circumferential direction. In other words, each of the first dogs 41 has a form of being continuous in the revolution direction of the rotary tank 56.

The first proximity switch 42 is arranged so as to horizontally face the rotation path of the first dog 41 from the outside in the radial direction (the outer peripheral side of the first dog 41). While the first dog 41 is close to the first proximity switch 42, a detection signal is output from the first proximity switch 42 to the controller 17. When the first proximity switch 42 detects the first dog 41 in the rotation process of the turrets 54 (the revolution process of the rotary tanks 56), it is determined that the rotary tank 56 corresponding to the detected first dog 41 is present in the detection area D. Here, since the first dog 41 has a certain length in the revolution path of the rotary tanks 56, a region with a certain range continuous along the revolution path of the rotary tanks 56 is set as the detection area. D.

As shown in FIG. 12, the second detection means 43 includes a light emitting unit 44 and a light receiving unit 45. The light emitting unit 44 and the light receiving unit 45 are arranged so as to face each other in the lateral direction with the detected part 72 (the lever 69) interposed therebetween, in a state where the rotary tank 56 is positioned at a circumferential central part of the detection area D and also the detected part 72 (the lever 69) of the clamp shaft 66 of the rotary tank 56 is positioned at the fixing position or in the vicinity of the fixing position.

The facing direction of the light emitting unit 44 and the light receiving unit 45 is almost orthogonal to the turning direction of the detected part 72 in a region near the fixing position in the turning path of the detected part 72 between the fixing position and the releasing position (generally the vertical direction). Further, the facing direction of the light emitting unit. 44 and the light receiving unit 45 is generally orthogonal to the tangential direction at the circumferential central part within the detection area D in the revolution path of the rotary tanks 56 (the vertical direction).

As shown in FIGS. 13 and 14, the light emitting unit 44 has a linear light source 46 that is elongated in the vertical direction. The linear light source 46 (the light emitting unit 44) emits a band-shaped laser light 47 (detection light set forth in the claims). The width direction of the laser light 47 is almost parallel to the turning direction of the detected part 72 in the region near the fixing position in the turning path of the detected part 72 (generally the vertical direction). An upper end of the emission range of the laser light 47 is set to be higher than an upper end of the detected part 72 when the detected part 72 is positioned above the fixing position. A lower end of the emission range of the laser light 47 is set to be lower than a lower end of the detected part 72 when the detected part 72 is positioned at the fixing position.

The light receiving unit 45 receives all of the laser light 47 emitted from the light emitting unit 44 and having arrived without being blocked by any other member. The light receiving unit 45 detects a light reception range, in the width direction (the vertical direction), of the laser light 47. Specifically, a ratio between a light emission region in the width direction of the laser light 47 emitted from the light emitting unit 44 and a light reception region in the width direction of the laser light 47 received by the light receiving unit 45 is detected.

The detection information of the light reception region in the light receiving unit 45 is output from the second detection means 43 to the controller 17 in order to decide the fixation state of the barrel lid 59 by the clamp shaft 66. The controller 17 decides whether the clamp shaft 66 is in the fixing form or in the releasing form, based on the detection information of the light reception region which is output from the second detection means 43.

Furthermore, the first detection means 40 is also a means having a function of detecting whether the second detection means 43 has properly executed detection on all of the four rotary tanks 56, in order to avoid erroneous detection by the second detection means 43. Specifically, when the detection by the first detection means 40 is executed at least four times, so that it is thereby detected that the detection by the second detection means 43 has been surely executed once for every rotary tank 56.

Figure 10:
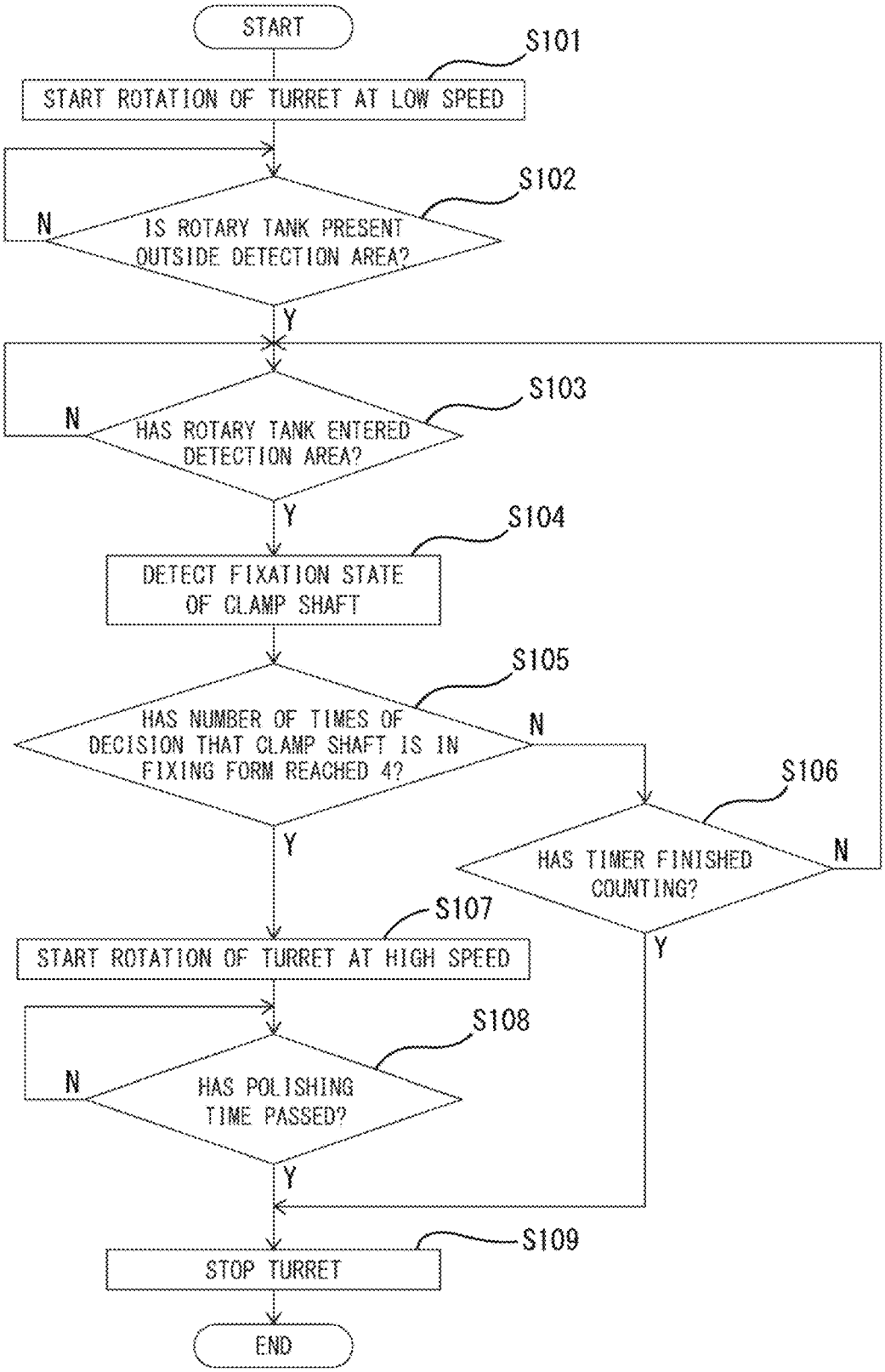
FIG. 10 is a flowchart showing procedures for detecting the fixation state of the barrel lid.

In the centrifugal barrel polishing machine B of Example 2, the procedures for detecting the fixation state of the barrel lid 59 and the procedures for controlling the rotation of the turrets 54 are executed according to the same procedures as those of the flowchart in FIG. 10 referred to in Example 1. Therefore, the descriptions of the specific procedures are omitted.

The centrifugal barrel polishing machine B according to Example 2 includes the rotatable turrets 54, four rotary tanks 56, four barrel lids 59 that are individually attachable to and detachable from the four rotary tanks 56, four clamp shafts 66, the first detection means 40, and the second detection means 43. The rotary tanks 56 are provided at eccentric positions of the turrets 54 and planetarily rotate with the ration of the turrets 54. The clamp shafts 66 are provided individually in the four rotary tanks 56 so as to planetarily rotate integrally with the rotary tanks 56.

Each of the clamp shafts 66 is displaceable between in the fixing form for fixing the barrel lid 59 attached to the rotary tank 56 and in the releasing form for releasing the fixation of the barrel lid 59 to the rotary tank 56. The first detection means 40 detects whether the rotary tank 56 is positioned in the detection area D set on the revolution path of the rotary tank 56. The second detection means 43 detects whether the clamp shaft 66 of the rotary tank 56 positioned in the detection area D is displaced to the fixing form.

According to this configuration, whether the barrel lid 59 is fixed to the rotary tank 56 can be determined based on the detection result of the second detection means 43 when the rotary tank 56 is positioned in the detection area D. Since the first detection means 40 for detecting whether the rotary tank 56 is positioned in the detection area D is provided, the barrel lids 59 attached to all the rotary tanks 56 can be detection targets of the second detection means 43. As a result, it is possible to avoid the detection by the second detection means 43 being overlooked. Therefore, the detection as to whether the barrel lid 59 is fixed to the rotary tank 56 can reliably be executed for all the barrel lids 59.

Further, before barrel polishing, the fixation state of the barrel lid 59 is confirmed in the process of rotating the turrets 54 at least by ¾ revolution and at most by one revolution. In this confirmation process, the rotation of the turrets 54 is configured to be stopped on the condition that the second detection means 43 has detected that the clamp shaft 66 provided in at least one of the rotary tanks 56 among the four (plurality of) rotary tanks 56 is not displaced to the fixing form. According to this configuration, it is possible to prevent barrel polishing from being executed in a state where the barrel lid 59 is not properly fixed. Therefore, it is possible to prevent damages to the centrifugal barrel polishing machine B and generation of defective polishing products (workpieces) due to the improper fixation of the barrel lid 59.

Further, the displacement direction of the clamp shaft 66 (the detected part 72) between in the fixing form and in the releasing form (generally the vertical direction) may be a direction intersecting the irradiation direction of the laser light 47 (the lateral direction). According to this configuration, the displacement amount of the clamp shaft 66 (the detected part 72) between in the fixing form and in the releasing form is large on the projection plane orthogonal to the irradiation direction of the detection light (the plane appearing in the figure). Therefore, the detection by the second detection means 43 can be performed with high accuracy. Further, because of high directivity of the laser light 47, it is possible to prevent erroneous detection due to irradiation with the detection light to a member other than the clamp shaft 66.

Further, the light emitting unit 44 has the vertical linear light source 46. The length direction of the linear light source 46 is a direction along the displacement direction when the rotary tank 56 revolves in the detection area D, and also is a direction along the displacement direction of the detected part 72 when the detected part 72 of the clamp shaft 66 moves around the fixing position and the vicinity thereof. According to this configuration, the detection by the second detection means 43 can be performed with high accuracy, even if there is a variation in the position of the rotary tank 56 on the turrets 54 in the revolution direction, in the attachment position of the clamp shaft 66 in the rotary tank 86, or in the displacement position of the clamp shaft 66 (the detected part 72) in the fixing form.

Further, the clamp shaft 66 is configured to be displaced (rotated around the axis) at an eccentric position with respect to the rotation shaft 55 of the rotary tank 56. The rotation cycle of the rotary tank 56 is an integral multiple of the revolution cycle of the rotary tank 56. According to this configuration, the clamp shaft 66 (the detected part 72 of the lever 69) of every rotary tank 56 always face a specific direction (front side) when the rotary tank 56 is positioned in the detection area D, regardless of the number of rotations of the turrets 54. Therefore, it is not necessary to adjust the orientation of the rotary tank 56 or the clamp shaft 66 when detection by the second detection means 43 is performed.

Other Examples

The present invention is not limited to the example described by the above description and drawings, and the following examples are also included in the technical scope of the present invention.

(1) In Examples 1 and 2 above, the fixation state of the barrel lid with respect to the rotary tank (the fixation state of the barrel tank to the barrel case) is configured to be detected without stopping the turret. However, the fixation state of the barrel lid to the rotary tank may be detected in a state where the turret is stopped.

(2) In Example 1 above, the clamp shaft having the lever and the eccentric cam is used as the means for fixing the barrel tank to the barrel case. However, other fixing means, such as pressing a bolt penetrating the barrel case against the upper surface of the barrel lid, may be used as the means for fixing the barrel tank to the barrel case.

(3) In Examples 1 and 2 above, the first detection means is a magnetic type sensor that detects the first dog provided on the turret with the first proximity switch. However, the first detection means may be an optical type sensor that allows detection light to pass through the detection hole formed on the turret, or an electrical sensor that uses an encoder or the like provided in a servomotor that rotationally drives the turret.

(4) In Examples 1 and 2 above, the detection light emitted from the second detection means is a laser light. However, the detection light emitted from the second detection means may be light having lower directivity than that of the laser light.

(5) In Examples 1 and 2 above, the second detection means is configured to optically detect the displacement form of the fixation means using a laser light. However, the second detection means may be configured to magnetically detect the displacement form of the fixation means.

(6) In Examples 1 and 2 above, the operating means (the lever) for displacing the fixation means between in the fixing form and in the releasing form serves also as the detected part as the detection target of the second detection means. However, a dedicated detected part may be provided separately from the operating means.

(7) In Examples 1 and 2 above, the centrifugal barrel polishing machines in which one turret is provided with four rotary tanks (barrel cases, barrel tanks) have been illustrated. However, the present invention can be applied also to a centrifugal barrel polishing machine in which the number of rotary tanks provided on one turret is 3 or less, or 5 or more.

(8) In Examples 1 and 2 above, when the barrel lid is not properly fixed, the rotation of the turret is stopped when the turret rotates one revolution. However, instead of this configuration, the turret may be stopped immediately when it is decided, through the detection of the second detection means, that the fixation state of the barrel lid is improper.

(9) The form of Example 2 in which the rotary tank functions as the barrel main body can be applied to the centrifugal barrel polishing machine of Example 1 in which the turret and the rotary tanks rotate about the vertical rotary shaft.

(10) The form of Example 1 in which the rotary tank is composed of the barrel case and the barrel main body can be applied to the centrifugal barrel polishing machine of Example 2 in which the turrets and the rotary tanks rotate about the horizontal rotary shaft.

REFERENCE SIGNS LIST

A, B Centrifugal barrel polishing machine
D Detection area
12,54 Turret
18,55 Rotation shaft
21 Barrel case
24,59 Barrel tank
26,60 Barrel lid
32, 66 Clamp shaft (fixation means)
40 First detection means
43 Second detection means
44 Light emitting unit
46 Linear light source
47 Laser light (detection light)
50,56 Rotary tank:

The invention claimed is:

1. A centrifugal barrel polishing machine, comprising:
a rotatable turret;
a plurality of rotary tanks that are provided at eccentric positions of the turret and planetarily rotate with a rotation of the turret;
barrel lids that are attachable to and detachable from the rotary tanks; and
a plurality of fixation means that are provided individually in the plurality of rotary tanks so as to planetarily rotate integrally with the rotary tanks,
wherein each of the plurality of fixation means is displaceable between in a fixing form for fixing the barrel lid attached to the rotary tank and in a releasing form for releasing the fixation of the barrel lid to the rotary tank in a state where the barrel lid is attached to the rotary tank,
wherein it is detected by a first detection means whether the rotary tank is positioned in a detection area set on a revolution path of the rotary tank, and
wherein it is detected by a second detection means whether the fixation means of the rotary tank positioned in the detection area is in the fixing form or in the releasing form,
wherein the second detection means has a light emitting unit that irradiates the fixation means with detection light in parallel to a tangential direction of the revolution path of the rotary tank, and
wherein the rotation of the turret is stopped on the condition that the second detection means has detected that the fixation means positioned in the detection area is not displaced to the fixing form.

2. The centrifugal barrel polishing machine according to claim 1, wherein the detection area is set continuously in an arc shape along a revolution direction of the rotary tank.

3. The centrifugal barrel polishing machine according to claim 1, wherein a displacement direction of the fixation means between in the fixing form and in the releasing form is a direction intersecting an irradiation direction of the detection light.

4. The centrifugal barrel polishing machine according to claim 1, wherein the light emitting unit has a linear light source along the displacement direction of the fixation means.

5. The centrifugal barrel polishing machine according to claim 1, wherein the detection light is a laser light.

6. The centrifugal barrel polishing machine according to claim 1,
wherein the fixation means is configured to be displaced at an eccentric position with respect to a rotation shaft of the rotary tank, and
wherein a rotation cycle of the rotary tank is an integral multiple of a revolution cycle of the rotary tank.

7. A centrifugal barrel polishing method, comprising:
providing a rotatable turret, a plurality of rotary tanks that are provided at eccentric positions of the turret and planetarily rotate with a rotation of the turret, barrel lids that are attachable to and detachable from the rotary tanks, and a plurality of fixation means that are provided individually in the plurality of rotary tanks so as to planetarily rotate integrally with the rotary tanks, wherein each of the plurality of fixation means is displaceable between in a fixing form for fixing the barrel lid attached to the rotary tank and in a releasing form for releasing the fixation of the barrel lid to the rotary tank in a state where the barrel lid is attached to the rotary tank;

detecting, by a first detection means, whether the rotary tank is positioned in a detection area set on a revolution path of the rotary tank;

detecting, by a second detection means, whether the fixation means of the rotary tank positioned in the detection area is in the fixing form or in the releasing form; and then stopping the rotation of the turret on the condition that the second detection means has detected that the fixation means provided in at least one of the plurality of rotary tanks is not displaced to the fixing form in a process of rotating the turret by one revolution before barrel polishing to confirm a fixation state of the barrel lid.

* * * * *